US012454830B1

(12) United States Patent
Kroboth

(10) Patent No.: US 12,454,830 B1
(45) **Date of Patent: *Oct. 28, 2025**

(54) TARP SUPPORT APPARATUS AND SYSTEM

(71) Applicant: Anthony F. Kroboth, Lehighton, PA (US)

(72) Inventor: Anthony F. Kroboth, Lehighton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/975,620

(22) Filed: Dec. 10, 2024

Related U.S. Application Data

(63) Continuation-in-part of application No. 18/178,284, filed on Mar. 3, 2023, now Pat. No. 12,203,272.

(51) Int. Cl.
*E04F 10/06* (2006.01)

(52) U.S. Cl.
CPC ..... *E04F 10/0633* (2013.01); *E04F 10/0662* (2013.01); *E04F 10/0666* (2013.01)

(58) Field of Classification Search
CPC ..... E04F 10/0633; E04F 10/0662; E04F 10/0666
See application file for complete search history.

(56) References Cited

U.S. PATENT DOCUMENTS 1,991,358 A * 2/1935 Bessy ..... E04F 10/02 248/273
2,097,704 A * 11/1937 Smith ..... E04F 10/02 160/81
3,612,145 A * 10/1971 Darula ..... E04F 10/0681 160/67
3,720,438 A * 3/1973 Johnson ..... E04H 15/08 160/46
3,851,848 A * 12/1974 Wiele ..... E04F 10/02 55/483
4,094,415 A * 6/1978 Larson ..... A47F 5/0823 211/85.15
4,192,112 A * 3/1980 Reilly, Sr. ..... E04F 10/0633 160/46
5,148,640 A * 9/1992 Reilly, Sr. ..... E06B 9/40 52/74
5,174,352 A * 12/1992 Murray ..... E04F 10/0614 160/67
5,190,066 A * 3/1993 Joergensen ..... E04H 15/08 135/88.13

(Continued)

*Primary Examiner* — Beth A Stephan
(74) *Attorney, Agent, or Firm* — Wilkinson Law Office; Clinton H. Wilkinson

(57) ABSTRACT

A tarp support apparatus comprising an elongated structural member configured to support an edge of a tarp extending over a ground area under tension in a stretched orientation including a longitudinally extending track for slidably receiving a plurality of tarp fastener members configured to be secured to the track, wherein the tarp fastener members include a receiving element configured to engage with a fitting such as a grommet connected a tarp for securing an edge of the tarp to the elongated structural member, and in some embodiments also including a diverter member is attachable to the structural member at a location above the track section and extending over the tarp edge and any gaps between the structural member and the tarp edge, and in other embodiments the tarp edge is positioned in a channel of the longitudinally extending track.

20 Claims, 11 Drawing Sheets

(56) References Cited

U.S. PATENT DOCUMENTS

| | | | | |
|---|---|---|---|---|
| 6,131,638 | A * | 10/2000 | Levin | E04F 10/0681 160/71 |
| 6,279,641 | B1 * | 8/2001 | Malott | E04F 10/08 160/67 |
| 9,499,990 | B1 * | 11/2016 | Rodriguez | E04F 10/08 |
| 12,203,272 | B1 * | 1/2025 | Kroboth | E04F 10/02 |
| 2003/0172568 | A1 * | 9/2003 | Uccello | G09F 15/0025 40/590 |
| 2006/0070310 | A1 * | 4/2006 | Oliver | B60P 3/36 52/97 |
| 2010/0139872 | A1 * | 6/2010 | Caire | E04F 10/0607 160/46 |
| 2011/0198041 | A1 * | 8/2011 | Svirsky | E04F 10/10 160/61 |
| 2015/0376937 | A1 * | 12/2015 | Buermann | E04F 10/02 248/48.2 |
| 2021/0388615 | A1 * | 12/2021 | Selzer | E04C 3/04 |

* cited by examiner

TARP SUPPORT APPARATUS AND SYSTEM

CROSS-REFERENCES TO RELATED APPLICATIONS

The present invention claims priority from and is a continuation-in-part application of U.S. patent application Ser. No. 18/178,284, filed Mar. 3, 2023, which application is hereby incorporated herein by reference in its entirety.

BACKGROUND OF THE INVENTION

1. Field of the Invention

The present invention relates generally to systems and methods for securing flexible sheet-like protective coverings such as a weather-resistant tarp, canopy, or comparable articles in an extended orientation.

2. Description of the Related Art

Flexible sheet-like materials are often used as covers to shield or protect vehicles, equipment, supplies, ground areas and the like from environmental elements including rain, wind, ultraviolet rays from the sun, and snow, as well as airborne dust, pollen and other debris. Common examples of these protective coverings are flexible articles such as tarpaulins or "tarps," canopies, and other flexible sheet articles which may be formed of polyethylene, polyester, canvas, cloth, vinyl, and other suitable materials. Polyethylene tarps with woven fibers are particularly useful for many general applications in that they are relatively strong, lightweight, water resistant, and inexpensive. In some embodiments, spaced openings are provided along the peripheral edge of the tarp sheet and are reinforced by grommet or eyelet fittings. These fittings facilitate securing the tarp in a use position by attaching connectors such as bungee cords, rubber tarp straps, ratchet straps, and various hooks to the fittings. If used as a sunshade, for example, the protective sheet covering may be secured extending overhead at a suitable height off the ground under tension in a taut, stretched orientation. The tarp body may be attached by fasteners to spaced-apart poles supported on the ground, or one or more side edges of the tarp body may be attached to a supporting structure such as a vertical wall. As nonlimiting examples, fasteners secured to the supporting structure such as a hook or nail may be passed through the tarp fittings, or tarp straps may be connected extending between the support structure fasteners and tarp fittings.

It may be desirable to periodically move or adjust the position of an overhead flexible sheet covering. Using convention attachment systems, this would require detaching the flexible sheet covering from the support structure fasteners, moving the fasteners to a new location and/or installing new fasteners in such location, and then reattaching the fittings on the covering to the fasteners. In some cases, it may also be desirable to temporarily move the covering out of the way and then return it to the same position without having to physically detach the covering and/or cords from the support structure fasteners and then reattach the covering and/or cords to the fasteners, which can be time consuming and inconvenient. The support apparatus and system of the present invention therefore facilitates ease of hanging and positioning flexible sheet-like coverings such as a tarp. Further, while tarps are convenient for inexpensively covering small outdoor areas, if secured to a supporting wall at the location of the spaced-apart grommet fittings, gaps may be present between the tarp edge and supporting wall through which rain and other debris landing on the tarp can fall, which is undesirable. The present invention tarp support device in some embodiments is also effective in diverting rain and debris away from these gaps or eliminating such gaps.

SUMMARY OF THE INVENTION

The present invention is directed to an apparatus, system and method which is used for supporting a flexible sheet protective covering such as a tarp under tension in a raised position extending over a ground area for various uses such as a sun or rain shelter or to shield equipment, materials, supplies, and the like against environmental elements.

The support apparatus of the present invention in the various embodiments includes an elongated structural member or plate and multiple tarp fastener devices which are securable to the structural member. The structural member includes an elongated web or base and in some embodiments a pair of parallel longitudinal tracks are formed on a front side of the base, which tracks are sometimes referred to individually herein as the upper track and the lower track. In some embodiments, the tracks have a C-shaped cross-section, while in other embodiments the tracks may have a T-shaped cross-section, a rounded groove shape, or another suitable male extension or female receptacle configuration, and in other embodiments there may be a single track. The elongated structural member is configured to be coupled to a wide range of generally vertical, flat, stable surfaces such as a building wall, fence, pole, or stud. In some embodiments, the structural members will be provided in different standard lengths such as in 4-foot, 6-foot, 8-foot, 10-foot, or 12-foot sections, which lengths in other embodiments may be shorter such as 2-foot or 3-foot sections or may be longer. Multiple structural members of any desired length may be positioned end-to-end making the overall length easily adjustable to accommodate almost any length tarp or multiple tarps also laid end-to-end.

The tarp fastener devices are configured to be slidably mounted on or to the track of the elongated structural member and are repositionable on the fastener-receiving track. In some embodiments, the tarp fastener devices have a base member configured to be received to the track, and a connector member secured to the base member will extend outwardly from the base member and track. In some embodiments, the base member is lockable against lateral sliding or movement on the track such that the multiple fasteners can be secured at any desired spaced apart locations along the length of the track. In other embodiments, the tarp fastener members may be configured to slidably mount the tarp fastener to the track in a male-female or female-male connection relationship, and the tarp fasteners are lockable against sliding.

In some embodiments, the tarp support apparatus also includes an elongated diverter member which is securable in the upper track of the structural member. In an embodiment, the diverter member has a base and an extension portion secured to the base. The base of the diverter member is dimensioned to be secured on the upper track with the extension portion extending from the base forwardly and outwardly through a slot a forward side of the upper track. The extension portion will have a width such that the distal end extends over the fastener devices in the lower track as well as over any gaps formed between the tarp edge and the supporting structural member in order to divert rain, snow, and other debris that otherwise might fall through one of such gaps away from the gaps.

The base member or track connecting portion of the tarp fastener devices preferably can be selectively positioned along the length of the fastener receiving track by sliding the base member along the track. In some embodiments, the fastener devices may be releasably locked against movement in a desired location on the track, wherein to reposition the fastener device the base member is first released from a secured position, then repositioned or moved to a desired new location on the lower track, and then secured in the new portion. The tarp connector member of the fastener devices in some embodiments will have a hook portion which can either be passed through a corresponding tarp eyelet or grommet fitting on a side edge of the tarp, or alternatively a cord or strap member or other suitable securing member may be connected between the tarp grommet or eyelet fitting on one end and the connecting member on the tarp fastener devices on the other end. The cord or strap may similarly have a connector on its ends for securing the cord between the eyelet and hook portion.

In some embodiments, the extension portion of the diverter member is hingedly connected to the base member, such that the distal end of the extension portion will pivot downwardly into contact with the upwardly facing surface of the tarp covering body. Gravity will continually urge the distal end of the extension portion into contact with the tarp body, which will increase the effectiveness of the diverter member in inhibiting rain from flowing under the extension portion towards the edge of the tarp covering. In some embodiments, the outer or distal end of the extension portion will be weighted to further urge the distal end into continuous contact with the upwardly facing surface of the tarp body, preventing the extension portion from rotating upwardly out of contact with the tarp under most standard wind conditions. In some embodiments, the additional weight may be provided by an increased thickness of the material used in forming the distal end of the extension portion as compared to the proximal end, or by inserting a suitably dense material such as sand, tungsten, lead, and other materials into a hollowed distal end of the extension portion. One or more channels may also be formed in the upper surface of the extension portion which will gather rain on the extension portion of the diverter member and direct it laterally toward the sides of the tarp covering. In some embodiments, the diverter member may be pivotally connected directly to a concave groove in the track, while in other embodiments the entire edge of the tarp being secured to the structural member is located within a track channel, in which embodiments the gaps spaces between the structural member and edge of the tarp are eliminated and a diverter member is not required.

Further areas of applicability of the present invention will become apparent from the detailed description provided hereinafter. It should be understood that the detailed description and specific examples, while indicating a preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
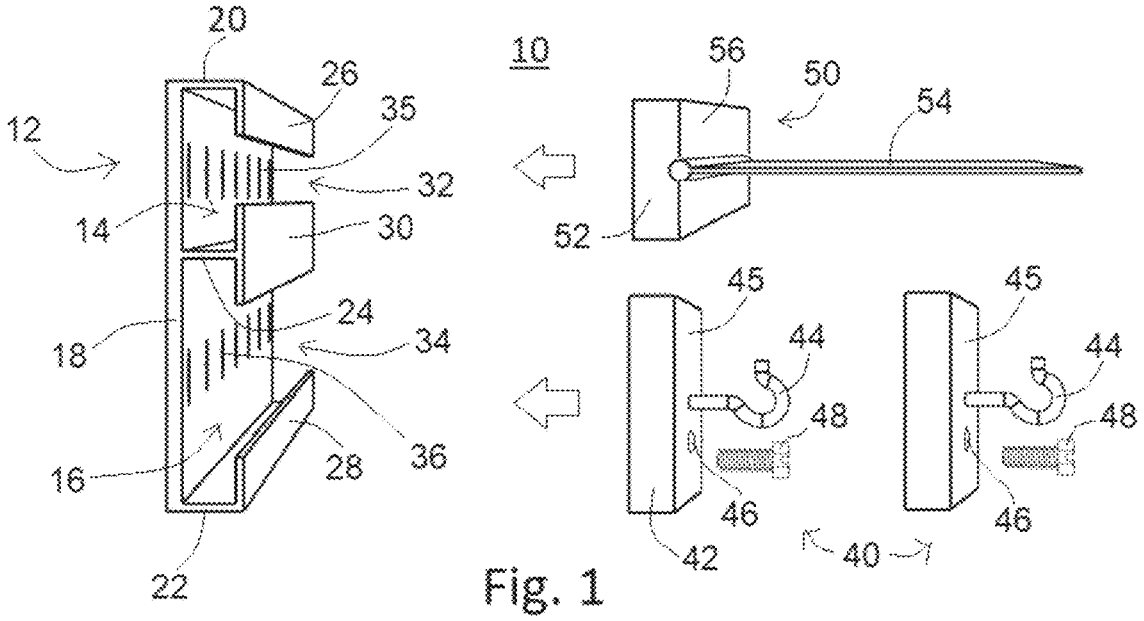
FIG. 1 is a side perspective view showing the components of an embodiment of the apparatus for supporting a flexible sheet-like protective covering article including an elongated structural member, fastener devices, and a diverter member.
Figure 2:
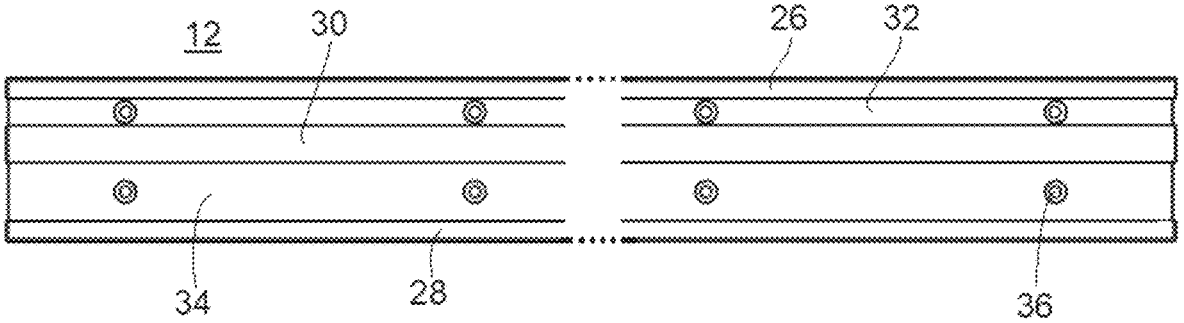
FIG. 2 is a partial front elevation view of the elongated structural member as in FIG. 1.

Reference will now be made in detail to embodiments of the present invention, examples of which are illustrated in the accompanying drawings. While the present invention will be described in conjunction with the several embodiment(s), the description is not intended to be understood in a limiting sense, but to be an example of the invention presented solely for illustration thereof, and by reference to which in connection with the following description and the accompanying drawings one skilled in the art may be advised of the advantages and benefits of the invention. On the contrary, the present invention is intended to cover alternatives, modifications, and equivalents, which may be included within the spirit and scope of the invention as defined by the appended claims. Further, it will be appreciated that embodiments of the present disclosure may employ any combination of features described herein. Descriptions of well-known starting materials, equipment, components, and processing techniques may be omitted so as to not unnecessarily obscure the embodiments herein.

In the description of the present invention, it should be understood that the terms "upper," "lower," "top," "bottom," "left," "right," and the like refer to orientations or positions based on those shown in the drawings. The terms are only for the convenience and simplification of the description of the present invention, rather than indicating or implying that the device or element referred to must have a specific orientation or be constructed and operated in a specific orientation. The terms "first" and "second" do not represent the importance of components, and therefore cannot be construed as limiting the present invention. The specific dimensions used in describing the exemplary embodiments are only for illustrating the technical solution without limiting the protection scope of the present invention. Reference herein to a "first embodiment," "an embodiment," "another embodiment," and like terms means that a particular feature, structure, or characteristic described in connection with the embodiment is included in at least one embodiment of the disclosure. The phrases "in an embodiment" or "in one embodiment" as used herein are not necessarily all referring to the same embodiment, nor are separate or alternative embodiments mutually exclusive of other embodiments. Moreover, various features are described that may be exhibited by some embodiments and not by others. Similarly, various requirements are described which may be requirements for some embodiments but not others.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," "joined," or any variant thereof, means any connection or coupling, either direct or indirect, between two or more elements. Additionally, the words "herein," "above," "below," and words of similar import, when used in this document, shall refer to this document as a whole and not to any particular portions of this application. If the specification states a component or feature "may," "can," "could," or "might" be included or have a characteristic, that particular component or feature is not required to be included or have the characteristic.

As used herein, the singular forms "a," "an," and "the" include plural references unless the context clearly dictates otherwise. Unless defined otherwise, all technical and scientific terms used herein have the same meaning as commonly understood by one of ordinary skill in the art. When used in this document, the term "exemplary" is intended to mean "by way of example" and is not intended to indicate that a particular exemplary item is preferred or required. When terms such as "first" and "second" are used herein to modify a noun, such use is simply intended to distinguish one item from another and is not intended to require a sequential order unless specifically stated.

Figure 5:
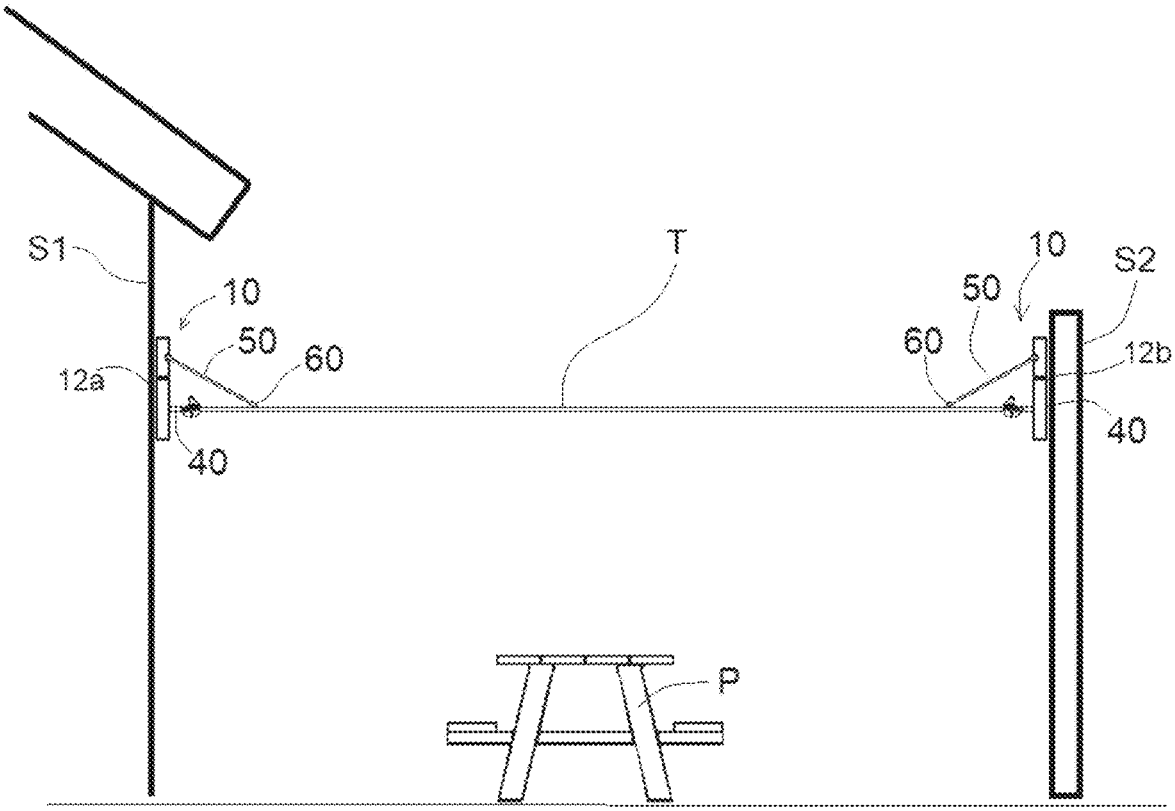
FIG. 5 a diagrammatic view illustrating the support apparatus in use supporting opposite side edges of a tarp article extending under tension over a ground area.
Figure 6:
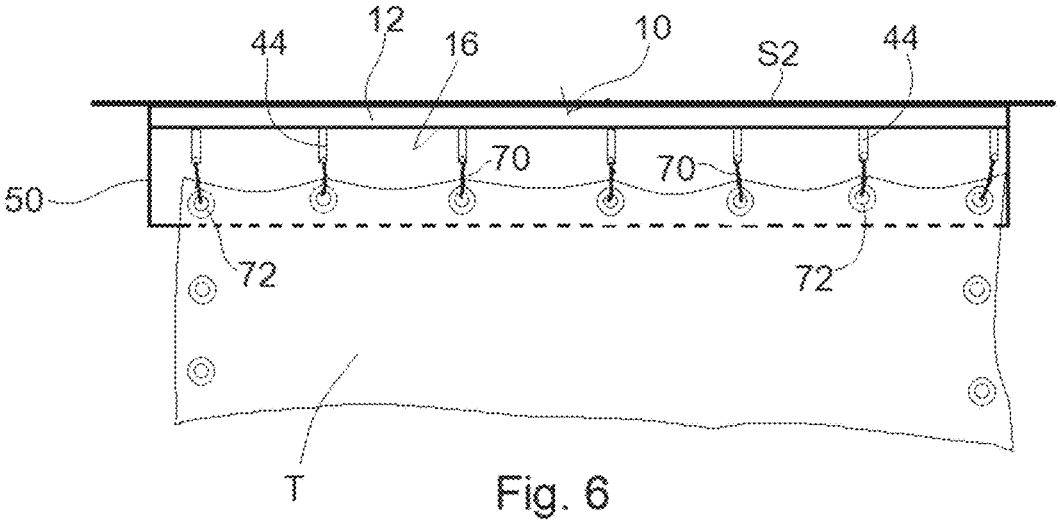
FIG. 6 is a partial bottom view of an embodiment of the tarp support apparatus in use and showing the position of the diverter member in relation to the fastener members and side edge of the tarp.
Figure 7:
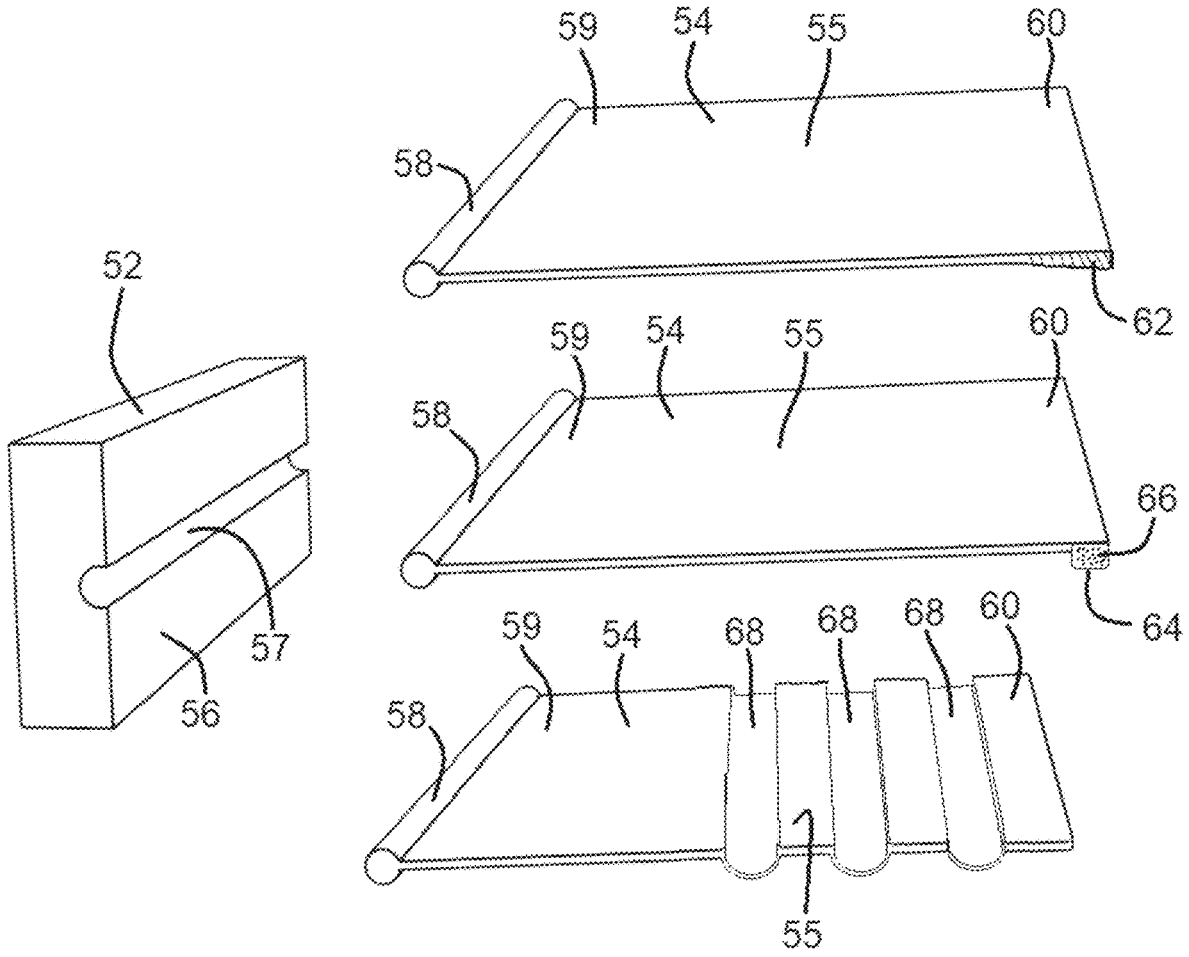
FIG. 7 is a perspective view of several alternative embodiments of the diverter extension member.
Figure 8:
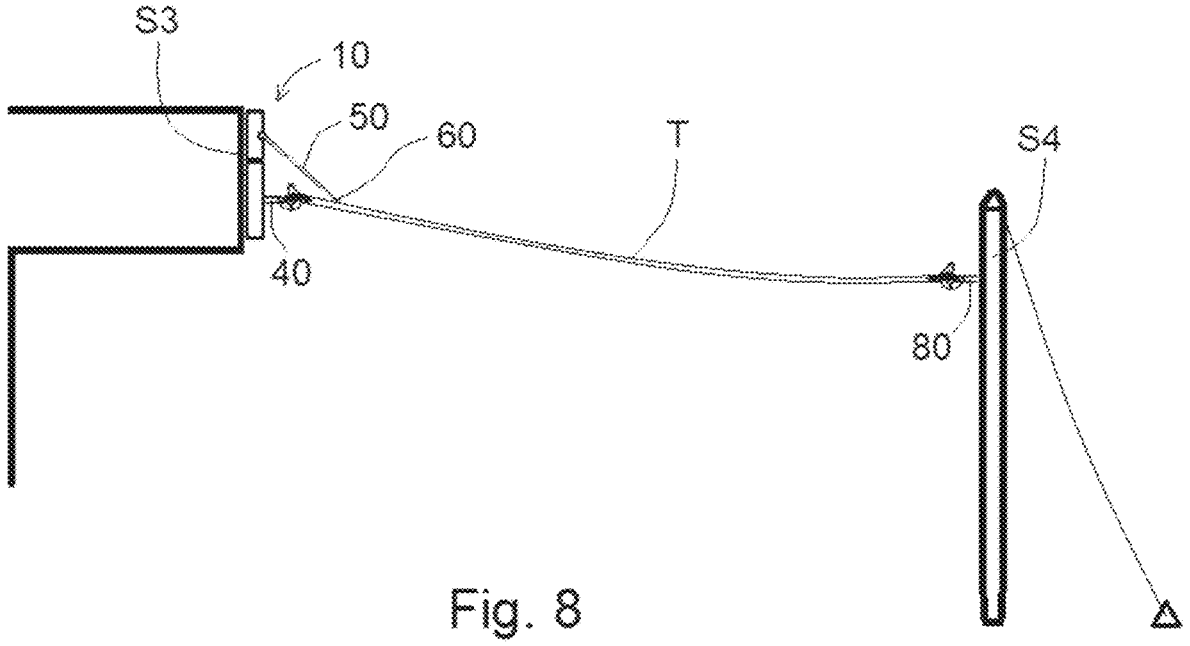
FIG. 8 is a diagrammatic view illustrating another manner of use of the support apparatus for supporting a tarp on opposite side edges.
Figure 9:
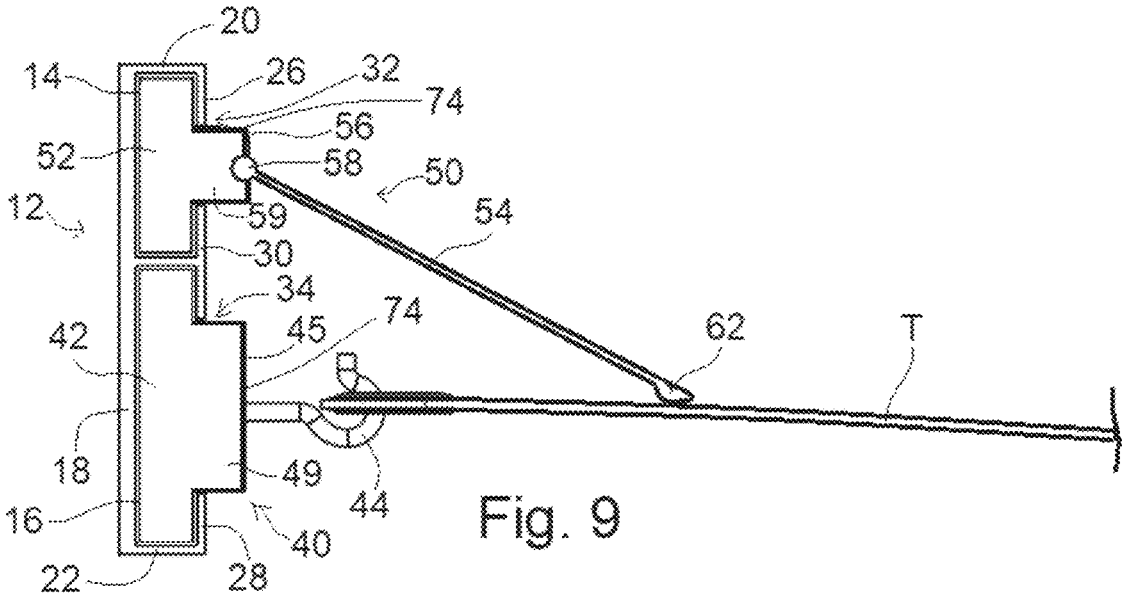
FIG. 9 is a side elevation view of another embodiment of the fastener devices secured to the structural member.

FIGS. 1-6 illustrate the components of an embodiment of a tarp support apparatus and system in accordance with the present invention, FIG. 7-9 illustrate several alternative features and uses, while FIGS. 10-18 illustrate further embodiments. Wherever practical, like reference numbers have been utilized to refer to like elements or features of the invention throughout the different embodiments illustrated herein. Referring now to FIG. 1, the main components of tarp support apparatus 10 are an elongated structural member 12, fastener devices 40, and diverter member 50. Structural member or rail member 12 in this embodiment has two longitudinally extending parallel track sections, also referred to herein as upper track section 14 and lower track section 16. As oriented in FIGS. 1-4, upper track section 14 is positioned above lower track section 16 which normally will be the preferred use orientation. Both track sections 14 and 16 have a C-shaped cross-section with open outers ends or sides, although as illustrated herein in other embodiments the track sections may have a differently shaped profile and one or both outer ends may be closed or capped. Structural member 12 includes a web or base 18 which during use forms a vertical rear side wall portion of the structural member 12, a top flange 20, a bottom flange 22, and an intermediate flange 24. Top flange 20 and bottom flange 22 are joined to opposite ends of the web 18, and intermediate flange 24 is joined to web 18 at an intermediate location between the top and bottom flanges 20 and 22. Top, bottom, and intermediate flanges 20, 22, and 24 project away from web 18 in the same direction, and in the exemplary embodiment extend perpendicular to web 18 and project outwardly the same distance and have the same length. In other embodiments, the flanges 20, 22, and 24 may project away from web 18 at other than a perpendicular angle such as at an acute angle and may have different lengths. A downwardly directed rib 26 is connected to the outer edge of top flange 20, an upwardly directed rib 28 is connected to the outer edge of bottom flange 22, and a transverse rib 30 is connected to the outer end of intermediate flange 24 extending transversely to flange 24. In the illustrated embodiment, upper, lower, and intermediate flanges 20, 22, and 24 therefore are substantially parallel, and ribs 26, 28, and 30 are substantially vertically aligned and parallel to web 18, although in other embodiments flanges 20, 22 and 24 and ribs 26, 28 and 30 may have different dimensions and angles. Upper track section 14 is configured to form an elongated interior channel defined by the inner walls of web 18, top flange 20, rib 26, upwardly facing wall of intermediate flange 24, and the inner wall portion of rib 30 above intermediate wall 24. A slot 32 is formed between the outer edges of ribs 26 and 30, which slot 32 is open to the interior channel of upper track section 14. Lower track section 16 in the exemplary embodiment is configured to form an elongated interior channel slightly larger than upper track section 14 defined by the inner wall of web 18, lower flange 22, and rib 28, the downwardly facing wall of intermediate flange 28, and the inner wall of the downwardly facing section of rib 30 below intermediate rib 24. A slot 34 is formed between the outer edges of ribs 28 and 30, which slot 34 opens into the interior channel of lower track section 16. The web 18, flanges 20, 22, and 24, and ribs 26, 28, and 30 will therefore be configured to form the desired dimensions of the interior channels of the upper and lower track sections 14 and 16.

The elongated structural member 12 will be fabricated of a suitable material including but not limited to stainless steel, aluminum, or other metal, plastic, composite material, wood, or combination of materials. In some embodiments, the structural member 12 is an aluminum extrusion. Spaced-apart apertures 35 are formed in web 18 of upper track section 14 and spaced-apart apertures 36 are similarly formed in web 18 of lower track section 16. Apertures 35 and 36 are preferably horizontally aligned with slots 32 and 34, respectively, and may be used to facilitate securing the structural member 12 to a wall or other support surface using suitable fasteners 37 (FIG. 3), which may be nail or screw fasteners or other suitable fasteners. The fasteners 37 will be passed into the apertures 35 and 36 from the inner wall side of web 18 and then into the support surface.

Figure 3:
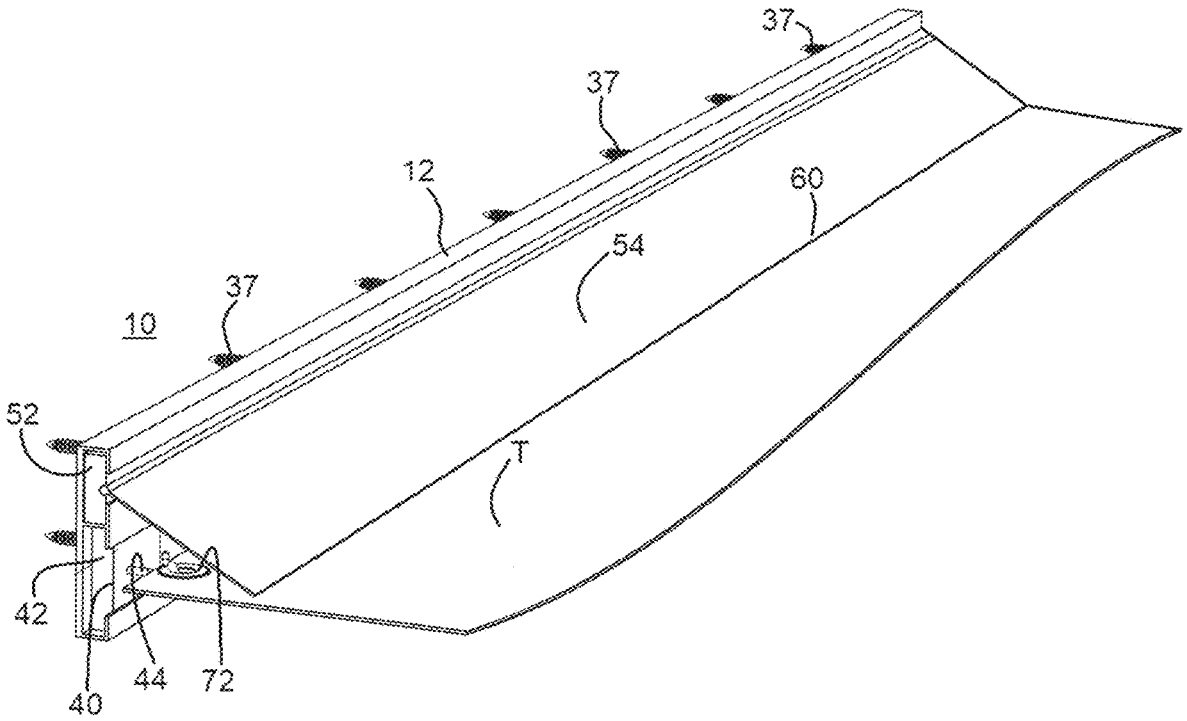
FIG. 3 is a perspective view illustration of a tarp secured to the structural member of the support apparatus in accordance with the invention.

The support apparatus 10 also includes one or more individually positionable tarp fastener devices 40, an exemplary embodiment of which is shown in FIG. 1. Each fastener device 40 has a base member 42 and a connector member 44 which is joined to base member 42 in a position extending outwardly from side wall 45 of the base member 42. Base member 42 may be a block, plate or other suitable member which is configured and dimensioned to be positioned in the interior channel of lower track section 16 by inserting the base member 42 into the interior channel from an end of the lower track section 16. Base member 42 is also configured to be movable longitudinally in lower track section 16 by manually sliding the base member 42 in the lower channel. As illustrated in FIG. 1, the interior channel of lower track section 16 has a rectangular cross-sectional profile, and the exemplary embodiment of base member 42 of fastener device 40 therefore has a similar cross-section with slightly smaller dimensions than lower track section 16 and is configured to fit snugly in the lower track section 16. In some embodiments, base member 42 may be other than rectangular such as including but not limited to being triangular in shape, although the base member 42 should still fit snugly in the lower channel. As shown in FIG. 3, when base member 42 of fastener device 40 is positioned in the lower track 16, connector member 44 will extend outwardly through the slot 34 formed between ribs 28 and 30. In some embodiments, and as shown in FIG. 9, the outwardly facing wall 45 of base member 42 may have a portion dimensioned to protrude through slot 34 in the lower track section 16.

Connector member 44 is joined to base member 42 by a means suited to the materials used, which means may include but is not limited to screw threads, welding, molding, or an adhesive. Connector member 44 is used to detachably secure a flexible sheet or panel such as a weather-resistant tarpaulin T shown in FIGS. 3 and 5-6 to the structural member 12 along a side edge of the tarp T. In some instances, the weather resistant flexible panel T will have a series of evenly spaced-apart fittings such as eyelets or grommets 72 secured to the tarp T along a periphery of the panel body. For example, the grommet fittings 72 may be spaced apart between 18 and 30 inches depending upon the weight or material of the tarp T. It will be understood that as many connector members 44 as are needed to secure the tarp T to a support structure will be positioned in the lower track section 16. In some embodiments, the connector members 44 may be spaced apart in approximately the same spaced relation as the eyelets or grommets 72 of the tarp T to secure the tarp T at the location of each of the grommets. The connector members 44 will be made of a suitable material such as a corrosion and rust resistant zinc alloy, other metals, plastics, or other materials, and may be formed integrally with the base member 42 or connected to the base member 42 such as by a screw hook or other means. While in the exemplary embodiment the connector members 44 are shown as conventional hook fasteners, in some embodiments the hook or attachment portion of connecting member 44 will have a spring closer member or snap hook which extends across the mouth of the hook portion to prevent the hook portion 44 from easily becoming disengaged from the grommet 70. The connector members 44 therefore may comprise other attachment members including but not limited to an eye hook, clevis hook, sling hook, self-locking hook, snap hook, carabiner, a specialized tarp connector, or other suitable joining member.

The fastener devices 40 will preferably be securable against lateral sliding in the lower track 16. In an embodiment, a threaded through-aperture 46 (FIG. 1) will be formed in base member 42 of fastener device 40 extending between the inwardly and outwardly facing walls of the base member, and a threaded fastener such as a bolt member 48 will be inserted in the aperture. Once the base member 42 is positioned as a desired longitudinal location in the lower track 16, the fastener 48 is rotated until the outer end of the threaded shaft is forcibly pressing against the inner wall of web 18 in lower track 16. This will cause the base member 42 to be urged forwardly in lower track 16 until the outwardly facing wall 45 of the base member 42 is forcibly pressing against the inner walls of the ribs 28 and 30. Base member 42 will then be frictionally engaged with the inner walls of ribs 28 and 30, securing the base member 42 against longitudinal sliding in lower track 16. In some embodiments the outer end of the bolt shaft may be capped or coated with a rubber or plastic material to protect the web 18 and bolt from wear. Other arrangements for securing the fastener devices 40 against lateral sliding such as a spring clip member positioned around the base member 42 which will continually press against the inner walls of the lower track 16, may be alternatively provided while still falling within the intended scope of the present invention.

In use, the elongated structural member or tarp support structure 12 of the tarp support apparatus 10 will be secured by fasteners 37 to a support structure such as a vertical building wall in close proximity to an area to be covered or protected by a tarp covering T. Normally, upper and lower track sections 14 and 16 will extend substantially horizontally although the structural members 12 can be oriented at other angles as needed to suit the particular intended purpose. When the body of the tarp covering or panel T is secured extending between the structural members 12 as shown in FIG. 5, since the grommets 72 are spaced apart as described above, as shown in FIG. 6 there will be one or more gaps between the edge of the tarp T secured to fasteners 42 and structural member 12. In order to prevent rainwater as well as other small debris such as leaves, pine needles from trees, leaf buds, and the like from gathering along the tarp edge and falling through these gaps either directly or due to the winds, the tarp support apparatus 10 also includes a diverter 50 which is secured in the upper track section 14. In use, as shown in FIGS. 3 and 6, diverter 50 will normally be positioned directly over the connector members 44 of fastener devices 40 in the lower track section 16. Diverter 50 will therefore redirect rainwater and other debris that otherwise may fall or drip through such gaps between the side edge of the tarp connected to lower rail 16 of the support structure 12 away from these gaps.

Diverter 50 in the illustrated embodiment includes an elongated base 52 and a similarly elongated extension member 54. Base 52 is dimensioned to fit snugly in the longitudinally extending interior channel of the upper track section 14 of support structure 12 when inserted from an outer end of the track section 14. As shown in FIG. 1, the channel formed by upper track section 14 has a rectangular profile, and therefore base 52 in an embodiment will have a similar rectangular profile with slightly smaller dimensions than the channel, while in other embodiments, the base 52 may have other profiles such as a triangular profile. Extension member or portion 54 is joined to the base 52 along a side wall 56 of the base 52 and is oriented extending away from side wall 56. Extension member 54 of diverter 50 will preferably extend along the entire longitudinal length of the upper track section 14, and in an embodiment will have a length that is substantially equal to the longitudinal length of the upper track section 14 of structural member 12. In other embodiments, diverter 50 may have a length greater than the longitudinal length of the upper track section 14 so the diverter 50 can extend between two or more aligned structural members 12, or in still other embodiments may be provided in shorter sections that are secured in an end-to-end relationship in the upper track section 14 of a single support structure or structural member 12. When base 52 of diverter 50 is positioned in the channel of upper track section 14, extension member 54 will extend away from side wall 56 of base 52 and outwardly through the slot 32 formed between ribs 26 and 30 of the support structure 12.

Base 52 and extension member 54 of diverter 50 will be made of a suitable material such as but not limited to metal or plastic, and base 52 may be made of a different material than extension member 54. In some embodiments, extension member 54 will be sufficiently rigid to support its own weight and remain in an extended use orientation, while in other embodiments may be bendable or angled into a desired position. One or more stiffening members or ribs, not shown, may be integrally formed or provided with the extension member 54 to minimize deformation, and other means of support may also be utilized as long as this does not interfere with positioning the base member 52 in the upper track section 14. While in some embodiments elongated structural member 12 and diverter 50 could be integrally formed as a single component, it is preferable that structural member 12 and diverter 50 are formed as separate components with the base 52 configured to be joined to the structural member 12 in the upper track section 14, as the structural member 12 and diverter 50 therefore may be formed of different materials. Forming the structural member 12 and diverter 50 separately also facilitates ease of shipping of the assembly by enabling the diverter to be laid flat with the structural member in a more compact shipping box. The extension member 54 may also be provided in different widths so the apparatus 10 can be more easily customized to the user's requirements. In some embodiments, for example, extension member 54 will have a width between about five inches and seven inches extending outwardly from base 52, while in other embodiments the extension member 54 may have a greater or lesser width. In a more preferred embodiment, extension member 54 will have a width of about six inches.

Figure 4:
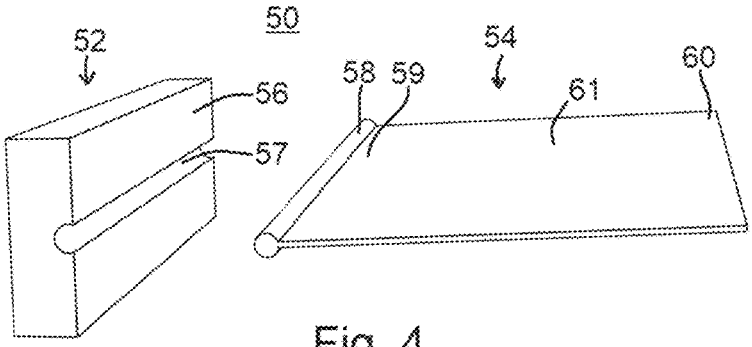
FIG. 4 is a perspective exploded view of an embodiment of the diverter member.

Extension member 54 in FIG. 4 is articulating, allowing for pivotal movement of the extension member 54 with respect to base 52 within a predetermined range of motion. A hinge joint for pivotally joining the extension member 54 to base member 52 is provided. As shown in FIG. 4, the hinge joint includes a rounded, concave groove 57 formed in forwardly facing side wall 56 of base 52, and a corresponding rounded, convex pivot member 58 configured to be positioned in the groove 57 formed on or affixed to the proximal end 59 of extension member 54. Extension member 54 therefore will be able to pivot freely with respect to base 52 within a predetermined range of motion. While in other embodiments different articulating connections may be provided, a hinge joint between base 52 and extension member 54 is preferred because articulating motion is only permitted in a single plane and therefore will prevent the extension member 54 from pivoting out of such plane. In some embodiments, extension member 54 is pivotable within a range of about 160 degrees, while in other embodiments extension member 54 will be pivotable within a greater or lesser range. During use of the tarp support apparatus 10, as shown in FIG. 3, the distal end 60 of the extension member 54 will pivot downwardly under its own weight into contact with the upwardly facing surface of tarp T, which is secured to the support structure 12 by fastener members 40 positioned in lower channel section 16 and hook connectors 44 which are secured in grommets 72. The articulating structure of the diverter 50 will continually urge the distal end 60 of the extension member 54 into contact with the body of tarp T, which will provide a better connection or seal between the extension member 54 and tarp T and will reduce leakage between the extension member 54 and tarp T.

In some embodiments, the distal end 60 of the extension member 54 may be additionally weighted. The additional weight will reduce the tendency of the extension member 54 to raise or lift upwardly off the body of tarp T during times of stronger winds, which often increase significantly during rainy or stormy periods. The added weight therefore will better maintain the distal end 60 of the extension member 54 downwardly sloped or angled and in contact with the upwardly facing surface of tarp T during most normal weather conditions. The weight of the extension member 54 will also cause the tarp body to sag slightly at the contact location, causing the portion of the tarp T between the edge connected to the structural member and the contact location to slope or angle downwardly away from the tarp edge towards the center of the tarp body, further reducing the likelihood of any liquid or debris being directed into any gaps between the tarp edge and the tarp support apparatus. As shown in FIG. 7, in some embodiments the weight of distal end 60 is increased by forming a thickened area 62 in distal end 60 of diverter extension member 54 as compared to the thickness of other portions of the diverter member panel. For example, if the extension member 54 is formed of molded plastic, thickening of the plastic on the distal end 60 to increase the weight of distal end 60 may be accomplished during the molding process. In other embodiments, a hollow cavity 64 may be formed in the distal end 60 of the extension member 54 which is then filled with a weighted material 66 such as sand or other relatively dense materials. The weight material 66 will be sealed in the cavity 64 to provide the added weight. In other embodiments, a weighted strip may be secured to the underside of the diverter extension member 54 in proximity to distal end 60. The structure providing additional weight to the distal end 60 of the extension member 54 should not inhibit or block rainwater from flowing down the extension member 54 on to the tarp T, and therefore it is preferred that the top surface 55 of the extension member 54 in such embodiments remains substantially flat at distal end 60. In another embodiment, longitudinal channels 68 will be formed in the top surface 55 of extension member 54, one of which is preferably in proximity to the distal end 60. Channels 68 may be differently dimensioned and angled to capture and divert substantial amounts of water collecting on the top surface 55 of extension member 54 away from the distal end 60 of the extension member 54 before it flows on to the tarp T. The channel 68 will direct the water towards the side edges of the tarp T. The distal end 60 of the diverter extension member 54 having channel 68 may also be weighted as in the other embodiments.

In FIG. 5, structural apparatus 12*a* is shown secured to a vertical wall of a building S1, and another structural apparatus 12*b* is shown secured to an opposite vertical surface S2 such as a fence, building overhang, or another wall which is spaced apart from structural apparatus S1. A tarp T or similar flexible sheet-like protective covering is secured by fastener devices 40 under tension extending between structural apparatuses 12*a* and 12*b*. As a result, the tarp T is secured under tension extending over a ground area where a picnic table P is located. Diverters 50 are positioned directly over the fastener devices 40 in the upper track 14 with distal end 60 of the extension member 54 engaged against the upwardly facing surface of the tarp T. Although not shown in FIG. 5, despite being secured to structural apparatuses 12*a* and 12*b* under tension, the body of tarp T will naturally tend to sag at least slightly, but the articulating diverter extension member 54 will pivot downwardly to remain in contact with the upwardly facing surface of the tarp T. The position of the tarp devices 40 on lower track 16 is slidably movably adjustable to accommodate different tarp configurations, and as shown in FIG. 6 fastener devices 40 may be spaced apart in lower track section or rail 16 of structural apparatus 12 at approximately the same distance as grommet fittings 72 of tarp T. The grommets 72 may be joined directly to the hook fasteners 44 of each fastener device 40, or as shown in FIG. 6 may be indirectly joined to fasteners devices which in FIG. are hook fasteners 44 by ropes, straps or bungee cords 70 with one end connected to the grommets 72 and the other end connected to the hook fasteners 44. Use of the intermediate straps or cords 70 may create a slightly larger gap along the side edge of tarp T connected to the support structure 12 but may be necessary in some cases to properly position the tarp T as desired.

In order to connect the fastener devices 40 to the grommets 72 of the tarp T, the fastener devices 40 may first be slidably positioned on the lower track 16 in a spaced-apart orientation. The fastener devices 40 are locked at a desired location along the length of track 16 by a suitable means such as in FIG. 1 by passing a threaded bolt 48 into an aperture 46 in the base member 42 of the tarp fastener devices 40. Rotation of the locking screw in a first direction will cause the outer end of the locking screw to forcibly press against the inner surface of the rear wall of lower track 16. This will cause the front surface the base member to be forcibly pressed in an opposite direction against an inner surface of the arms 28 and 30. The aperture in base member 42 in which the locking screw is received will preferably be substantially aligned with the slot 34 in the track 16 such that the locking screw can be easily rotated to be locked an unlocked using a screwdriver or screwdriver drill bit passed into the track 16 via slot 34. In another embodiment, a spring member or members may be provided along the inner surfaces of the upper and lower legs of lower track 16. The spring members will resultingly exert a constant outward force or tension against the upper and lower side surfaces of the base member 42 of the tarp fastener devices 40 when the base members 42 are slidingly inserted into track 16. To slidingly reposition the fastener devices 40, the user can manually grasp the fastener device 40 by the hook portion 44 in order to urge the base member upwardly or downwardly in the channel of track 16. This will cause the spring, depending on whether the base member 42 is pressed upwardly or downwardly, to be urged inwardly and temporarily reduce the combined force exerted on the base member 42 by the springs enough for the fastener device 40 to be manually slid in either direction in the channel to a new use position. Then, when the repositioned fastener device 40 is released, the spring members will again automatically engage with the base member 42 and hold the tarp fastening member 40 in the new position.

In another embodiment for securing or locking the tarp fastener devices 40 at a desired location along the length of track 16, instead of a spring member being installed in the channel of track 16, a spring member is secured along the outer surface of the base member 42 of each of the tarp fastener devices 40. The spring member would have an outwardly curved portion which extends along the rear surface of the base member 42, and a pointed bottom portion extending downwardly from the lower surface of the base member 42. The outwardly curved section and pointed bottom section provide a constant outward tension force on the base member 42, continually urging the base member 42 against the top and front inner surfaces of the track 16 sufficient to hold the fastener devices 40 in position in track 16. To move or relocate the tarp fastener devices 40, the fastener device 40 is pressed downwardly and rearwardly in the channel, which will cause the pointed bottom section and outwardly curved section of the spring member to moved towards the securing member. At the same time, the fastener device 40 is released and can be slide in the track 16. The user then simply releases the fastener device 40 when it has been moved to a desired new position, wherein the spring tension will be sufficient to maintain the securing member in the new position up to a predetermined maximum.

The present invention can be used to support flexible covers, tarps or comparable articles in a wide range of applications which may range from lightweight to heavy duty uses, as well as covers or tarps manufactured of varied materials such as canvas, vinyl, poly, mesh, or nylon. The tarp support apparatus 10 can be used to secure a flexible covering in an overhead position for many different possible uses such as a patio cover, trailer cover, breezeway cover connecting between two buildings, rain or sun shield, and other uses. In some embodiments, the elongated structural members 12 are mounted on opposite sides of an area to be covered and may be secured at the same height as in FIG. 5, or may be at different heights such that the tarp will be at an angle, which will urge water falling on the tarp to drain in a desired direction. FIG. 8 illustrates another manner of use wherein one tarp support apparatus 10 is secured to vertical wall S3 of a building overhang. Tarp fittings 72 along a side edge of tarp T are secured to fasteners 40 of apparatus 10 as described above, while the opposite side edge of tarp T is secured to one or more hooks 80 connected to upright posts S4 which may be supported by a ground stake and rope. As compared to FIG. 5, wherein tarp T is shown connected extending between two apparatuses 10 coupled to opposite building wall S1 and wall S2, in FIG. 8 only one apparatus 10 attached to overhang S3 is used, and in addition the tarp T is angled downwardly towards post S4 so that water and other debris contacting the upwardly facing surface of the body of tarp T will naturally drain away from structure S3 and towards post S4. Another post S5 (not shown) may be spaced apart from post S4 to hold another side of tarp T. Thus, depending upon the particular desired configuration or mode of use, the apparatus 10 may be used alone or in combination with another apparatus 10 secured to another support structure, or may be used alone.

FIG. 9 illustrates another embodiment of the invention in which in addition to base member 42 of fastener device 40 being dimensioned to fit snugly in lower track section 16, fastener device 40 additionally has an extension portion 49 which may be formed integrally with base member 42 and is configured to extend outwardly through the front slot 34 of the structural member 12. In addition, base member 52 of diverter 50 which is dimensioned to fit snugly in upper track section 14 similarly has an extension portion 59 configured to extend outwardly through front slot 32. Extension portions 49 and 59 protrude away from structural or rail member 12 and in some cases will provide a sturdier and closer fit in the track sections 14 and 16, and may be useful in supporting longer, heavier diverter portions 54 and adjusting the attachment location of tarp T. A rubber covering or gasket 74 may be provided over the outer surfaces 45 and 56 of the extension portions 49 and 59 to inhibit intrusion of water into the track sections 14 and 16.

Figure 10:
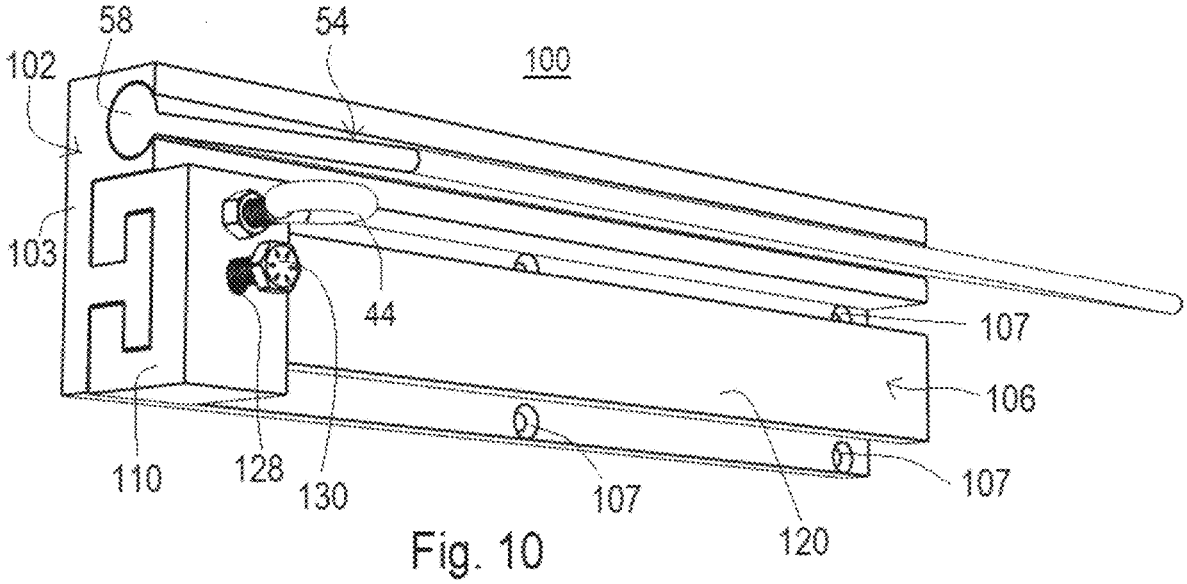
FIG. 10 is a perspective view of another embodiment of the tarp support apparatus of the invention.
Figure 11:
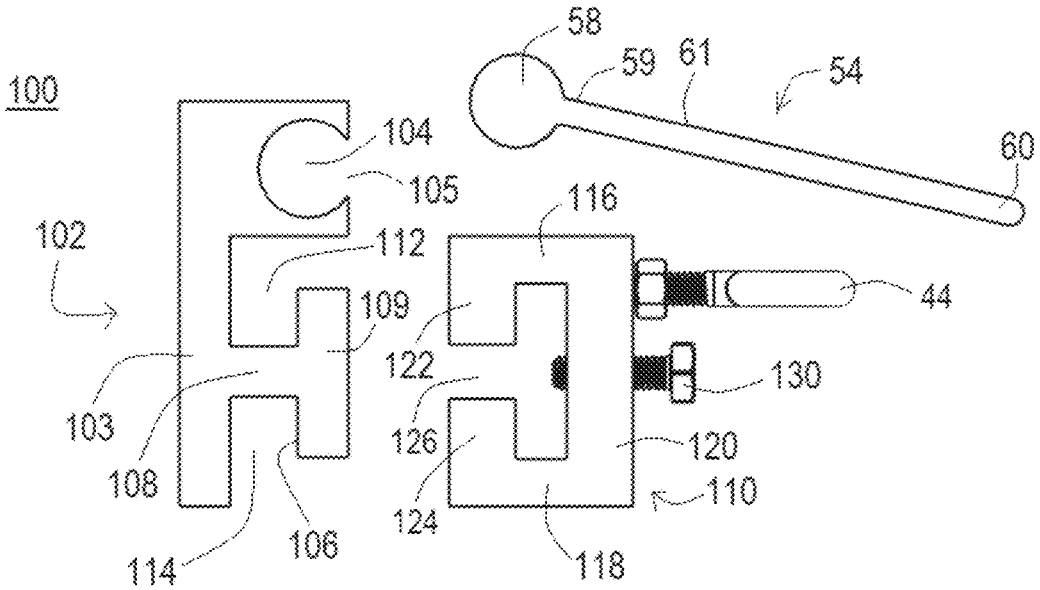
FIG. 11 is a side elevation view of the components of the tarp support apparatus as in FIG. 10.

FIG. 10-11 illustrate another embodiment of the tarp support apparatus and system of the present invention. As in the previous embodiments, tarp support apparatus 100 includes an elongated structural member 102 having a web 103 forming a vertical rear wall portion of member 102. Instead of having integrally formed upper and lower C-shaped track sections on a front side of web 103 in which a base member 42 or 52 of the tarp fastener members is internally received, in this embodiment structural member 102 includes a longitudinally extending upper track formed as a concave groove 104, while the longitudinally extending lower track is formed as T-shaped track section 106 positioned below groove 104. As best shown in FIG. 11, a front slot or opening 105 opens to groove 104, which groove 104 forms part of a hinge joint configured to attach a diverter member 54 directly to the structural member 102. Spaced-apart apertures 107 are formed extending between front and rear side walls of the web 103 and are shown in one row between groove 104 and rail 106 and in another row below rail 106, which rows of apertures are preferably horizontally aligned on web 103. Apertures 107 facilitate mounting the structural member 102 to a wall or other support surface using suitable fasteners 37 (as shown in FIG. 3), which may be nail or mounting screw-type fasteners that are passed into the apertures 107 from the outwardly facing side of web 18 and then into the support surface.

Groove 104 has a concave inner wall surface and is integrally formed as part of the structural member 102, rather than being formed in base 52 of diverter 50 as in the previously described embodiments, thus eliminating the base 52 of diverter 50 as a separate required component of the diverter 50 and further reducing material and manufacturing costs. As in the earlier described embodiments, diverter member 54 includes a pivot member 58 connected to an extension member 61 (also referred to as diverter panel 61). Pivot member 58 is attached to proximal end 59 of diverter panel 61 and has a convex shape corresponding to groove 104 which is configured to be slidably inserted into groove 104 of structural member 102 from an open end of the groove 104, with extension member or diverter body 61 extending outwardly through slot 105. As previously described, diverter member 54 may be made of any suitable material such as but not limited plastic, metal, and wood, and preferably diverter body 61 is a thin flat panel and is sufficiently rigid to support its own weight. While in some embodiments diverter member 54 may be integrally formed as part of the elongated structural member 102, by forming the structural member 102 and diverter member 54 as separate components, different materials can be used in their construction, and also these components of tarp support apparatus 100 can be easily laid flat during shipping. In addition, in certain scenarios, such as where structural member 102 is connected to a vertical support surface under an overhang, or to an underside of an overhang with the front side of web 103 facing downwardly, a user may wish to remove the diverter member 54 and utilize the apparatus 100 without the diverter member 54 at least temporarily. Diverter body 61 may have different widths between proximal end 59 and distal end 60 as long as the distal end 60 is positioned extending over any gaps or openings between the edge of a tarp T attached to the structural member 102 by the tarp fasteners 110 and the structural member 102.

In FIG. 10, diverter member 54 is pivotally connected to structural member 102 and is pivotal within a predetermined range of motion on the hinge joint formed by concave groove 104 and convex pivot member 58. The articulating motion of diverter member 54 is only permitted in a single plane since the hinge joint will prevent diverter body 61 of the diverter member 54 from pivoting out of a single plane. In some embodiments, the diverter body 61 may be pivotal within a range of about 160 degrees, while in other embodiments may be pivotable within a greater or lesser range as long as the distal end 60 is able to pivot downwardly beyond a horizontal plane, preferably into contact with an upwardly facing surface of a tarp T secured to the tarp supporting apparatus 100. Body 61 of the diverter member 54 will pivot downwardly under its own weight and distal end 60 will be continually urged towards and preferably into contact with the tarp T. As in the previously described embodiments, distal end 60 of diverter body 61 may have an increased thickness or density and a greater weight as compared to the thickness, density, and/or weight of the center portion of the diverter body 61 in order to reduce lifting of the diverter 54 upwardly away from or off of a tarp T due to the wind under normal atmospheric conditions. In some other embodiments, apparatus 100 may be constructed such that panel 61 is not pivotable, such as by reducing the width of front opening 105 connecting to groove 104 such that the diverter member 54 cannot pivot and is oriented at a desired angle with respect to the structural member 102. In other embodiments, a connection other than a hinge joint may be utilized to prevent pivoting.

T-shaped track section 106 has a male T-shape rather than a female channel or socket C-shape as in the embodiment shown in FIG. 1 and is configured to slidably receive multiple tarp fastener members 110 on the track 106 in order to secure a tarp T to the structural member 102. Track 106 as shown in FIGS. 10 and 11 is positioned below groove 104 on web 103 of structural member 102 and is connected to and projects outwardly away from the front side of web 103. The T-shape of track 106 as viewed in a cross section of the structural member 102 is comprised of a stem portion 108 and an outer portion 109 attached to the outer end portion of the stem portion 108. Outer portion 109 extends laterally beyond the corresponding sides of the stem portion 108, defining an upper slot 112 and a lower slot 114 on opposite sides of the stem portion 108, respectfully.

Tarp fasteners members 110 in the present embodiment are slidable on track 106 and may be attached to track 106 from an open end of the structural member 102. The fastener members 110 are female-type fasteners and have a substantially reverse C-shape including an upper portion 116, a lower portion 118, a front portion 120 joining and extending between the upper portion 116 and lower portion 118, an inwardly directed finger portion 122 extending downwardly from upper portion 116, and another inwardly directed finger portion 124 vertically aligned with finger portion 122 and extending upwardly from lower portion 118. A T-shaped slot 126 is defined by the upper portion 116, lower portion 118, front portion 120, and finger portions 122 and 124 of the fastener members 110. T-shaped slot 126 is configured to be slidably received over the T-shaped track 106 from an end of track 106, with finger portion 122 inserted in upper slot 112 and finger portion 124 inserted in lower slot 114, and with front portion 120 extending over the outer portion 109 of track 106.

The tarp fastener members 110 may be locked against sliding on track 106. Threaded through-aperture 128 is formed in front portion 120 of the fastener members 110, in which a threaded fastener such as a bolt member 130 may be inserted. Once a fastener 110 is moved to a desired longitudinal location on track 106, fastener 130 is rotated in an appropriate direction until the outer end of the threaded shaft is forcibly pressing against the front surface of outer portion 109 of track 106, frictionally engaging the fastener 130 with the track 106. In some embodiments, the outer end of the bolt shaft of fastener 130 may be capped or coated with a rubber or plastic material to protect track 106 from scratches or wear. In other embodiments, fastener may include a thumbscrew, or a knob, lever or other hand grip may be secured over or to the bolt head of the fasteners 130 to facilitate easier manual tightening or loosening of the fasteners 130. Other arrangements for securing the fastener members 110 against sliding on rail 106 as discussed in other places herein may also be provided while still falling within the intended scope of the present invention.

In addition, the fastener members 110 include a tarp connector member or securing element 44, which in the illustrated embodiment is secured extending outwardly from an outer face of the front portion 120. Securing element 44 may be joined to front portion 124 by a means suited to the materials used, which means may include but is not limited to screw threads, welding, molding, or an adhesive. Securing element 44 is used to detachably secure a fitting positioned in an opening formed along a side edge portion of a tarpaulin type covering T to securing element 44, connecting tarp T to structural member 100. In this embodiment, the connector 44 is shown as an eye hook screw, wherein in use the eye hook may be aligned with an eyelet or grommet fitting installed along a periphery of the tarp T. A suitable securing member including but not limited to a carabiner, snap hook, clip, cord, or specialized tarp connector device may then be passed through the aligned apertures in the securing member and connector 44 to secure the tarp T grommet to connector 44. It will be understood that as many tarp fastener members 110 as are needed to support the tarp T along a side edge portion of the tarp may be positioned in a spaced apart arrangement on track 106, although this is not strictly necessary for operation of the invention. Typically, the fastener members 110 will be spaced apart in approximately the same spaced relation as the eyelet or grommet fittings of the tarp T to secure the tarp T at the location of each of the fittings. While in the exemplary embodiment the connector 44 is shown as an eye hook screw, this is merely exemplary in nature and it will be readily understood that other connectors such as c-hook, clevis hook, sling hook, self-locking hook, snap hook, carabiner, or other suitable alternative joining members may also be utilized.

Figure 12:
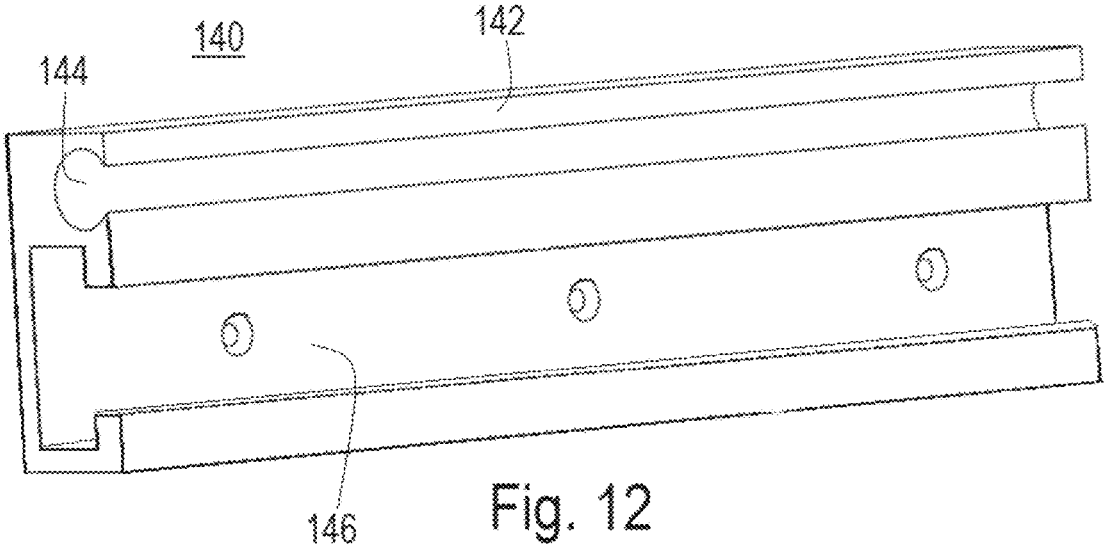
FIG. 12 is a perspective view of another embodiment of the tarp support apparatus structural member.

FIG. 12 illustrates another embodiment 140 of the structural member used in connection with the tarp support apparatus of the present invention. In this embodiment, tarp support apparatus 140 includes a structural member 142 having a longitudinally extending concave groove 144 for receiving an articulating diverter member 54 (not shown), as in FIGS. 10-11, and a longitudinally extending C-shaped lower track section 146 for securing multiple slidable fastener devices 40, as in FIGS. 1-4. As FIG. 12 illustrates, individual features of the embodiments shown in the various Figures and described herein are not limiting and can be arranged in different combinations according to user needs and preferences.

Figure 13:
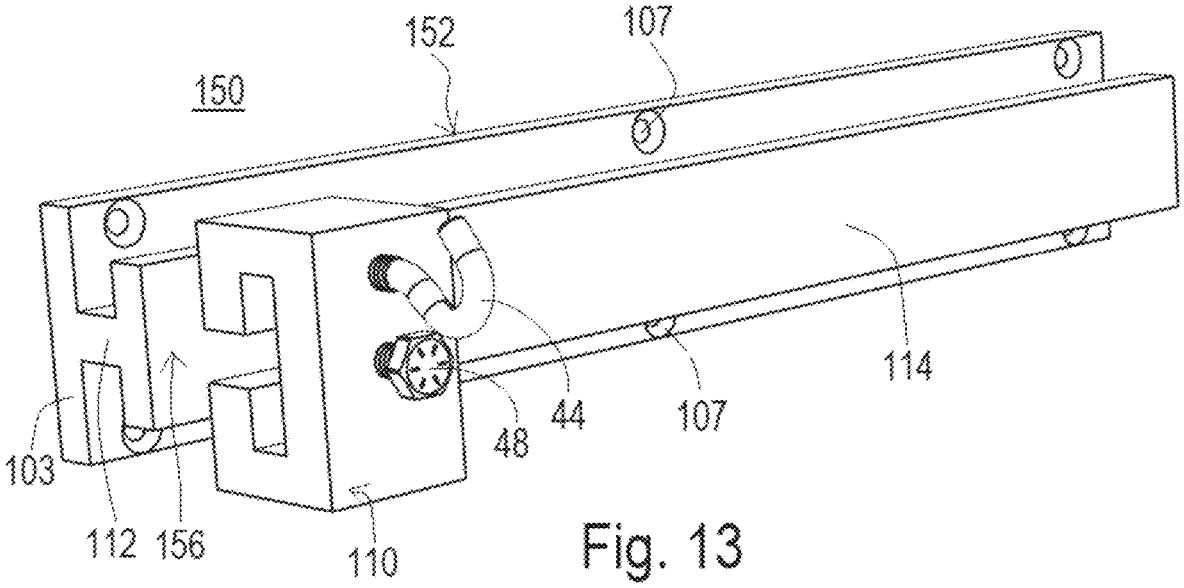
FIG. 13 is a perspective view of another embodiment of the tarp support apparatus.

FIG. 13 illustrates another embodiment 150 of the tarp support apparatus, which is substantially similar to apparatus 100 shown in FIGS. 10-11 except in tarp support apparatus 150 the elongated structural member 152 does not contain a longitudinally extending concave groove 104 above the T-shaped lower track 156. In addition, there is no diverter member 54. Tarp fastener member 110 also utilizes a screw hook as the connector 44 as in FIG. 1 rather than an eye hook as in FIG. 10 which further illustrates the alternative nature of the tarp connectors. The embodiment of structural member 152 shown in FIG. 13 may be preferred for use in indoor or covered areas such as in a warehouse or garage where there is little or no benefit to use of a diverter member.

Figure 14:
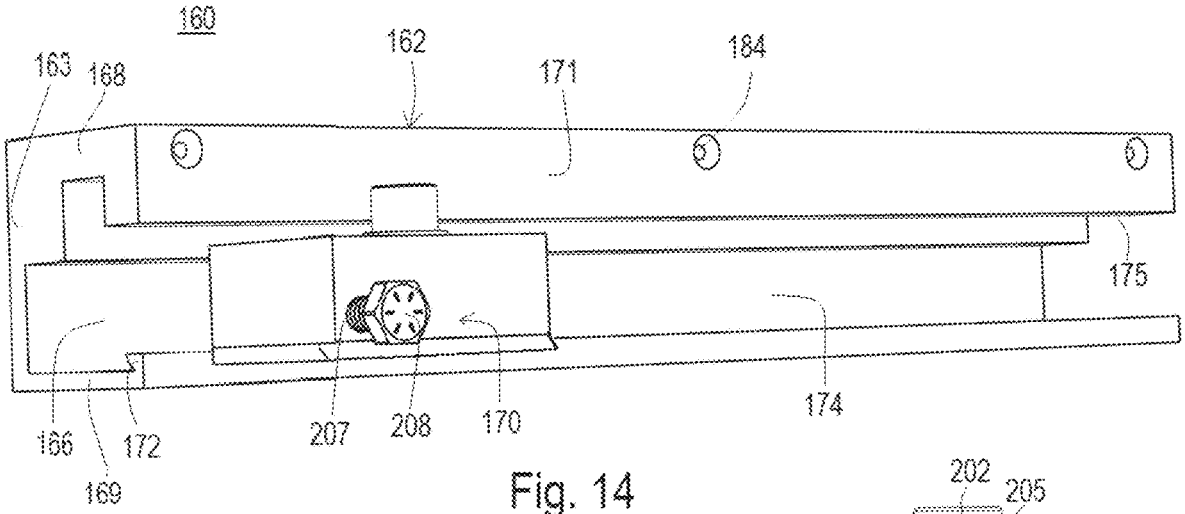
FIG. 14 is a perspective view of another embodiment of the tarp support apparatus.
Figure 15:
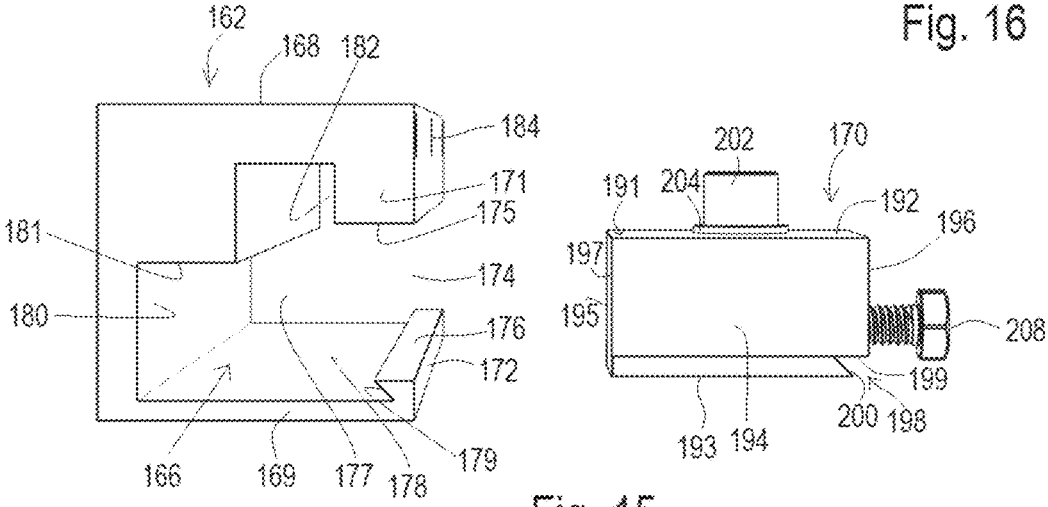
FIG. 15 is side view of the components of the tarp support apparatus as in FIG. 14.

FIG. 14-15 illustrate another embodiment 160 of the tarp support apparatus and system of the present invention which includes elongated structural member 162 and tarp fastener members 170. In this embodiment, elongated structural member 162 comprises a longitudinally extending track 166 positioned on a front side of web 163. Track 166 is configured such that when the grommet fittings secured along a side edge of a tarp T are connected to several spaced-apart tarp fastening members 170 which are mounted to the track 166, the grommet fittings and the entire edge of tarp T including between the fastener members 170 will be located in the channel forming the track 166 rather than the tarp edge being positioned in front of the track 166 as in previously described embodiments. As a result, the need for an additional upper track or groove for attaching a diverter member 54 to the structural member 160 above track 166 to block rain, snow, small debris falling from trees and the like from passing through any spaces between the tarp edge and the track, particularly between the spaced-apart tarp connectors, will be largely obviated. In this embodiment, any gaps or spaces formed between the edge of the tarp T and the track 166 between the fastener members 170 through which rain and debris could pass are largely closed or eliminated. In addition, as detailed below, tarp fastener members 170 may be slidingly received in either end of the track 166, while in some embodiments the fastener members 170 may also be inserted into the track 166 through front opening 174 at any location along the length of the track 166.

Web 163 forms a vertical rear wall of structural member 162. Track 166 formed on the front side of web 163 is defined by a top flange 168, a bottom flange 169, a top flange extension 171 connected extending downwardly from a distal end of top flange 168, and a lower lip portion 172 extending upwardly from a distal end of bottom flange 169. Top flange 168 and bottom flange 169 are joined to opposite upper and lower end portions of the web 163 and project perpendicularly away from web 103 in the same direction, and in the exemplary embodiment have the same width from web 163, although in some embodiments top flange 168 and bottom flange 169 may have different widths. In other embodiments, the top flange 168 and bottom flange 169 may project away from web 163 at other than a perpendicular angle from web 163 including at an acute angle. Front opening 174 is in fluid communication with and opens into the interior channel of track 166 and is defined between end wall 175 of top flange extension 171 and upper edge 176 of lip portion 172. The interior channel of elongated track 166 includes a main channel portion 177 defined by upper edge 176 of lip portion 172, lip inner wall 178, the inner wall of bottom flange 169, rear inner wall 180 of web 163, upper inner wall 181 and the end wall 175. Lip inner wall 179 is angled inwardly at an acute angle with respect to floor 178. In addition, track 176 also includes a longitudinal upper slotted channel portion 182 formed in upper inner wall 181 of top flange 168 and is in communication with main channel portion 177. Through-apertures 184 are formed in top flange 168 and are configured to receive fasteners for securing the structural member 162 to a support surface.

Tarp fastener or connecting members 170 in the exemplary embodiment comprise a base 191 having a substantially cuboid shape, although it will be understood that base 191 may have other than a cuboid shape and will be configured and dimensioned according to the shape and dimensions of main channel portion 177 of the track 176. Base 191 has opposing top and bottom walls 192 and 193, opposing side walls 194 and 195, and opposing front and rear walls 196 and 197, respectively. A notch 198 is formed in the lower corner of base 191 along the junction between front wall 196 and bottom wall 193. Notch 198 includes a horizontal bottom wall 199 and an inwardly angled side wall 200 and is configured to be received on lip 172. More particularly, inwardly angled wall 200 of notch 198 is configured to be aligned with angled wall 179 of lip 172 and bottom wall 199 is configured to be aligned with wall 176 of lip 172 when fastener member 170 is inserted in track 166.

Upright or post 202 is secured to base 191 extending outwardly from top wall 192. In addition, a tarp fitting receiving element 204 is formed on top wall 192 of base 191 in a position extending around a proximal end of upright 202. Upright 202 is configured to be received in the longitudinally extending upper channel portion 182 of track 166, and receiving element 204 is configured and dimensioned to receive a grommet fitting attached to a tarp T with the fitting extending around receiving element 204 after being passed over upright 202. Receiving element 204 in some embodiments is ring shaped sleeve and may have an outer diameter slightly less than the inner diameter of the smallest typical grommet type fitting, while in other embodiments receiving element 204 may be dimensioned to receive particular sized grommet fittings. In the illustrated embodiment, upright 202 is shown as being cylindrical but may have a rectangular shape or other shapes. Fitting receiving element 204 is preferably rounded as most grommet or eyelet fittings are round but may also be differently shaped as may be required.

Figure 16:
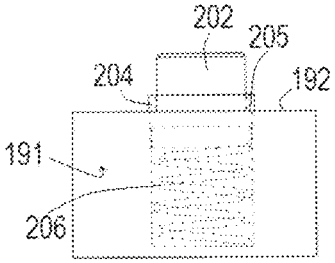
FIG. 16 illustrates one of the tarp fastener members having a spring-biased push button or upright.

As illustrated in FIG. 16, in some embodiments, post or upright 202 is formed as a push button member which is retractable into an aperture 205 in top wall 192 of base 191 bordered by fitting receiving element 204. Coil spring member 206 is positioned in base 191 and attached to upright 202 such that the upright 202 is spring-biased by spring member 206 to be maintained in an extended position out of base 191. In some embodiments, the distance between the top wall of button 202 when retracted or the upper edge of fitting receiving element 204 and bottom wall 203 is slightly less than the width of opening 174 between lower wall 175 of top flange extension 171 and top wall 176 of lip 172 in track 166. In such embodiments, in use, a grommet fitting attached to a tarp T may be inserted over the upright 202 and positioned around receiving element 204. Then, the tarp fastener member 170 can either be slidably inserted on to track 166 from either end of the track 166, or, upright 202 can be manually retracted into base 191 and the fastener member 170 can be inserted directly through the front opening 174 into the track 166 at a desired longitudinal location. When fully inserted, bottom wall 193 is seated on or directly adjacent floor 178 of the track 166, angled side wall 200 of cutout 198 is adjacent similarly angled wall 179 of track 166, horizontal bottom wall 199 of cutout 198 is directly adjacent or resting on wall 176 of lip 172, and upright 202 will be received in upper channel portion 182.

Lip 172 will prevent the fastener member 170 from sliding out of track 166 without first lifting the base 191 up and over the lip 172. Lip 172 also provides a surface against which the base 191 is biased when locked against sliding as described below. Once fastener member 170 is properly seated in track 166, the fastener member 170 may be secured in place in track 166. A through-aperture 207 (FIG. 14) is formed in base 191 extending between front wall 196 and rear wall 197, and a fastener such as bolt member 208 is provided which can be inserted in the through-aperture 207 and rotated until the outer end of the bolt shaft is pressing against rear wall 180 of track 166. This will cause base 191 to be forced forwardly outwardly in rail 166 until notch 198 is pressing against lip 172, frictionally securing the tarp fastener member 170 against sliding. This procedure may be repeated for each grommet fitting connected along a side edge of a tarp T to be attached to a fastener member 170 and then secured to structural member 160 in rail 162. In another locking arrangement, the portion of base 191 including the angled wall 200 of cutout 198 may be provided as a separate platform underneath base 191 which is slidably secured to base 191. In this arrangement the threaded shaft of the locking screw 208 is engaged with a threaded tab positioned in the interior of the base 191, rather than extending through rear wall 197. The threaded tab is attached to the platform such that when the locking bolt 208 is turned in a locking direction, the platform will slide forwardly until angled wall 200 is engaged with wall 179 of lip 172, locking the platform and tarp fastener member 170 against sliding in track 166. Structural member 162 and tarp fastener member 166 may each have different dimensions while still falling within the intended scope of the present invention.

Each grommet fitting positioned along a side edge portion of a tarp T and which is secured to structural member 160 can be secured to a separate fastener member 170 before the members 170 are inserted on to track 166, or, alternatively the fastener members 170 may first be individually connected to a grommet fitting and then consecutively secured to track 166. The fastener members 170 with grommet fittings attached are each slidably positioned and secured in a spaced-apart relation on rail 166. If a tarps or panel does not have grommets fittings or they are not properly spaced according to the user's requirements, a cord can be tied around an bunched-up area of the edge of the tarp body T and the cord can then be looped over upright 202 and receiving element 204 in a similar manner as the fittings. Preferably, the fastener members 170 will be spaced apart on track 166 such that there is a tension on the side edge of the tarp T attached to track 166 between the fastener members 170. It will be understood that the tension on the T tarp between pairs of fastener members 170 may be adjustable by varying the spacing of the fastener members 170 on track 166. With sufficient tension the entire edge of the tarp T extending between the spaced-apart fastener members 170 can be positioned in track 166 underneath top flange 168, leaving no spaces or openings between the tarp edge and the track 166 through which rain and other debris could easily pass. The position of the fastener members 170 on track 166 may be periodically adjusted as needed, either to temporarily fold or remove the tarp T from over a particular ground area or space, or to increase the tautness of the tarp T if it begins to sag due to stretching. In some embodiments, top flange 168 may extend outwardly further than lip 172 so that any water dripping from top flange 168 will be further away from front opening 174 of track 166. In some other embodiments, the upper surface of the top flange 168 can be slightly concave such that any rain falling on to the upper surface of the top flange 168 will collect on the top surface and eventually drain off towards the ends of the structural member 162, rather than dripping off the front edge onto the tarp T.

Figure 17:
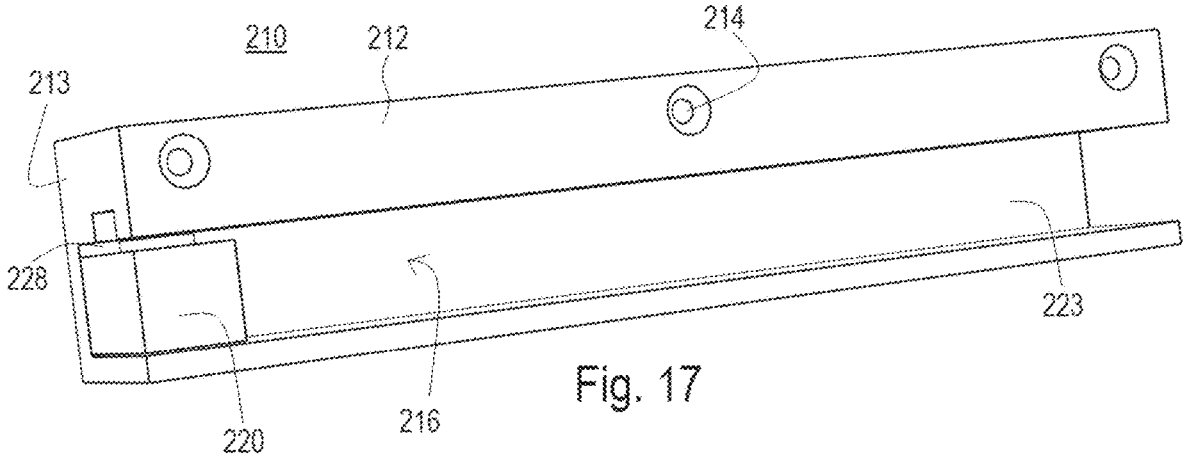
FIG. 17 is a perspective view of another embodiment of the tarp support apparatus.
Figure 18:
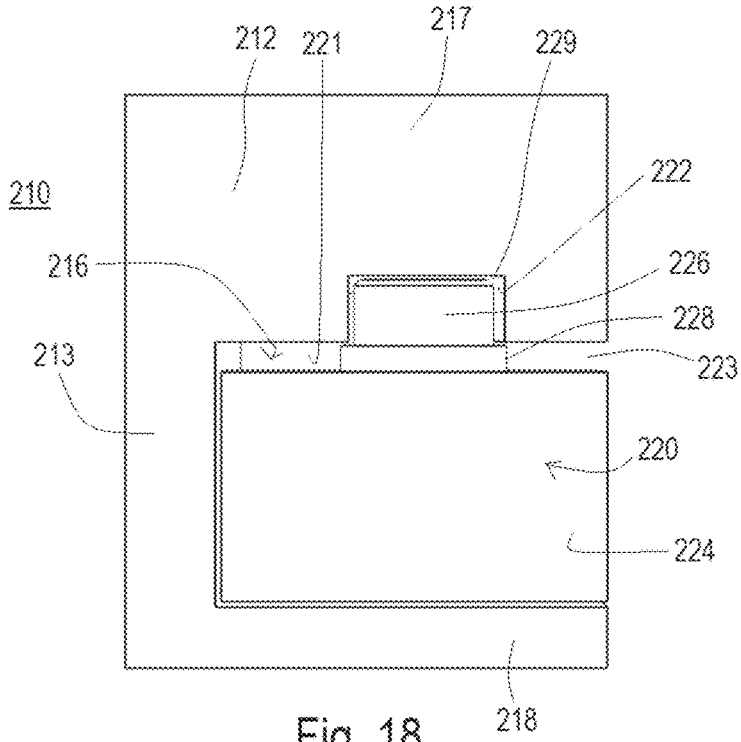
FIG. 18 is an end view of the components of the tarp support apparatus as in FIG. 17.
Figure 19:
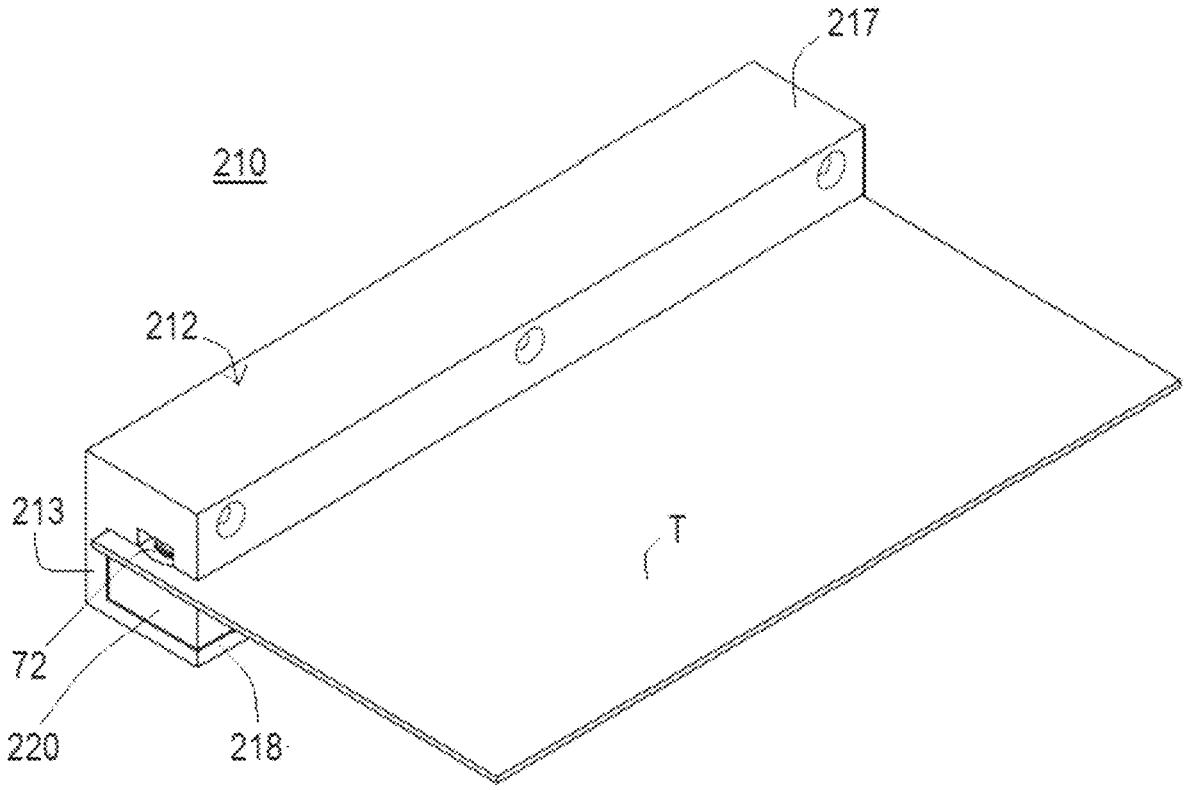
FIG. 19 illustrates the tarp support apparats as in FIGS. 17-18 in use supporting a tarp T.

FIGS. 17-19 illustrate another embodiment of a tarp securing apparatus and system 210 in accordance with the present invention, which embodiment is substantially similar to the embodiment shown in FIGS. 14-15 except in this embodiment, track 216 does not have a lower lip 172 or a screw-type securing member. Structural member 212 includes web 213 with track 216 formed on a front side of the web 213 and a channel defined by a combination of the walls of web 213, top flange 217, and bottom flange 218. Longitudinal track 216 has a main channel portion 221, an upper channel portion 222 formed in top flange 217 which is in fluid communication with main portion 221, and a front opening 223 in fluid communication with main portion 221. Tarp fastener member 220 has a base 224, a spring-biased upright 226 secured to base 224 extending from a top wall of the base 224, and a tarp securing element 228 positioned extending around a periphery of the upright 226. The force of upright 226 pressing against the top wall 229 of upper channel portion 222 by the spring is sufficient to both hold the fastener member 220 in the track 216 as well as against lateral sliding in the track 216. In some embodiments, one or both of the top wall 229 of upper channel portion 222 or the top surface of upright 226 may be lined with a rubberlike or other friction increasing sheet or coating to increase the frictional hold between upright 222 and top wall 229.

As shown in FIGS. 18 and 19, when the tarp fasteners 220 are secured in track 216 with the tarp grommets 72 around receiving elements 228, the edge of tarp T and the grommet fittings 72 will be located near the top wall of main channel portion 221. As a result, the outward force on the fastener members 220 will also be located near the top wall of main channel portion 221, rather than being lower on the fasteners 220, such that when under tension as a result of supporting tarp T the fasteners 220 will not be pulled out of the track 216 under normal use conditions. In some embodiments, however, a short lip may be provided near the bottom front of opening 223 to ensure the bottom end of the fastener base 221 is secure. Since the tarp T extends outwardly from the track 216 near the top of the front opening 223, there is less room for water and debris to enter the track 216. Further, as shown in FIG. 19, the entire edge of the tarp T is positioned in the main channel portion 221. In some embodiments, the upright 226 and upper channel portion 222 may be differently positioned in the track 216 and on base 221 so as to be set back even further in the track 216, also moving the grommet fitting receiving elements 228 back further into the main channel portion 221 of the track 216 and therefore also moving the tarp T edge further into the track 216.

Figure 20:
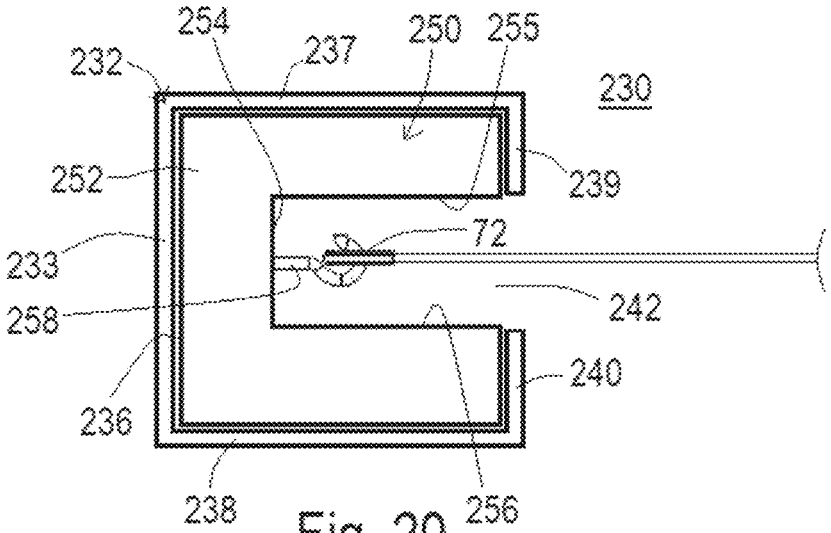
FIG. 20 is an end view of another embodiment of the tarp support apparatus.

FIG. 20 illustrates another embodiment of a tarp securing apparatus and system 230 in accordance with the present invention, which embodiment includes an elongated structural member 232 having a web 233 defining a rear wall of the structural member 233 with longitudinal track 236 formed on a front side of the web 233. Track 236 is shown as a C-shaped channel defined by a combination of the walls of web 233, top flange 237, bottom flange 238, downwardly directed rib 239, and upwardly directed rib 240. Longitudinal track 236 also has a front opening 242. Tarp fastener member 250 has a base 252 configured to be slidably received in an end of the track 236 and may be secured against sliding in track 236 as previously described with respect to other embodiments. Fastener member 250 in this embodiment has a recessed area 253 defined by a recessed front wall 254 bordered by recessed upper and lower walls 255 and 256. Securing element 258 is attached extending outwardly from recessed front wall 254, and as shown in FIG. 20 a grommet fitting 72 is secured to a hook portion of securing element or connector 258 to secure the tarp T to the fastener member 250, which is then in turn secured to structural member 232. In other embodiments, the tarp securing element may be secured to the recessed upper wall 255 or recessed lower wall 256, and may be any suitable type of receiving element, including a post or sleeve as in FIGS. 18 and 19, a hook or eyelet type fastener, or other suitable fastener or tarp securing element.

Figure 21:
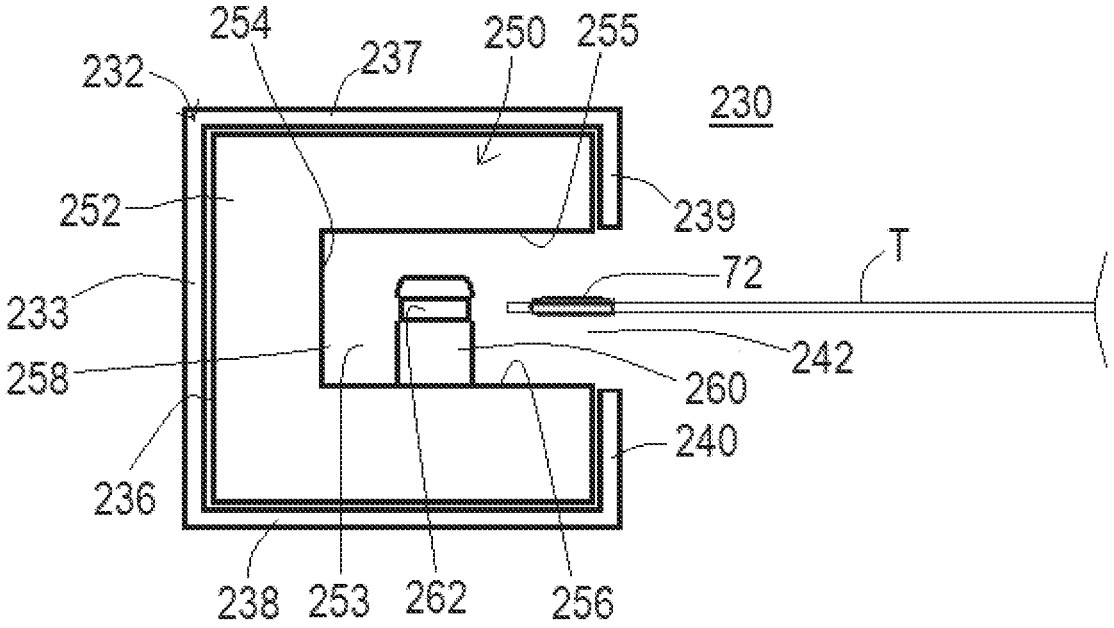
FIG. 21 is an end view of another embodiment of the tarp support apparatus.

FIG. 21 illustrates another embodiment which is similar to the embodiment shown in FIG. 20, except in FIG. 21, the securing element on base 252 of the fastener member 250 is attached to recessed lower wall 256 and is in the form of a post 260 extending upwardly within recessed area 253. Post 260 has a reduced diameter section 262 in its sidewall spaced from the ends of the post 260. Eyelet or grommet fitting 72 of flexible sheet-like article or tarp T is positioned over post 260 from the top and is slid downwardly into reduced diameter section 262 of the post 260. It will be appreciated that the grommet fitting 72 of tarp T connected to fastener element 258 as well as the edge of the tarp is positioned well within the channel of the track 236 such that rain, snow, and other debris will be inhibited from getting under the tarp P along this side edge.

It will be readily understood that in addition to the embodiments illustrated the tarp connector rail on the structural member may be reconfigured while still falling within the intended scope of the present invention. This includes numerous alternative male-female and female-male connection relationships wherein the rail comprises either the male or female part and the tarp fastener members comprise either the matching female or male part. For example, in some embodiments the stem portion of the T-shaped rail may be split into two spaced-apart stem portions separately connected to the web, with each stem portion supporting a section of the front portion, and a gap between the separate stem and front portions in which a single row of horizontally-aligned spaced-apart apertures may be formed to facilitate securing the structural member to a support surface using suitable fasteners.

The foregoing description has been presented for purposes of illustration and description and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. An apparatus for supporting a flexible sheet-like article in a stretched orientation under tension extending over a ground area, the flexible sheet-like article having a side edge and plurality of spaced-apart openings formed along the side edge with eyelet fittings mounted in the openings, the apparatus comprising:

an elongated structural member including a web having a rear wall configured to be secured to a support surface, a front side portion, and a longitudinally extending track integrally formed on the front side portion; and a plurality of fastener members each including a base configured to be slidably mountable to the track, and a securing element connected to the base configured to be detachably connected to one of the eyelet fittings of the flexible sheet-like article, wherein the base is securable against longitudinal sliding on the track.

2. The apparatus of claim 1, wherein the track further comprises a longitudinally extending interior channel, and wherein when one of the plurality of fastener members is secured to the track and the securing element is attached to one of the eyelet fittings mounted to the flexible sheet-like article, the securing element and the eyelet fitting are positioned in the internal channel.

3. The apparatus of claim 2, wherein the interior channel further comprises a main channel portion, a front opening in fluid communication with the main channel portion, and a slotted channel portion in fluid communication with the main channel portion, wherein the base of the plurality of fastener members is dimensioned to be received in the main channel portion, the fastener member further comprising a post connected to the base extending outwardly from the base and configured to be received in the slotted channel portion.

4. The apparatus of claim 3, wherein the securing element of the fastener member further comprises a sleeve attached to the base in a location extending around the post.

5. The apparatus of claim 3 further comprising an aperture in the base, wherein the post is mounted to be base in the aperture, a sleeve attached to the base in a location extending around the post, wherein the post is movable between an extended position and retracted position, and a biasing device positioned in the base and mounted to the post to bias the post into an extended position.

6. The apparatus of claim 5 wherein the base is dimensioned to be passed through the front slot in the track when the post is in a retracted position.

7. The apparatus of claim 2 wherein the track further comprises a lower lip portion wherein the base of the fastener member fits over the lower lip portion when secured to the track.

8. The apparatus of claim 2 further comprising a recessed area in the base of the fastener member, the recessed area defined between a recessed front wall, a recessed upper interior wall, and a recessed lower interior wall, wherein the securing element of the fastener member is positioned in the recessed area and secured to one of the recessed front wall, upper interior wall, and lower interior wall.

9. The apparatus of claim 8 wherein the securing element is a post secured to the recessed upper interior wall or recessed lower interior wall, the post having a reduced diameter section configured for receiving one of the eyelet fittings mounted to the flexible sheet-like article.

10. The apparatus of claim 1 further comprising an elongated diverter member connectable to the structural member extending longitudinally above the longitudinally extending track, the diverter member including a diverter panel extending outwardly from the front side portion of the structural member over the plurality of fastener members.

11. The apparatus of claim 10 wherein the structural member further comprises a groove formed in front side portion of the web above and extending parallel to the longitudinally extending track, the groove including a front slot in fluid communication with the groove, wherein the diverter member is connectable to the groove.

12. The apparatus of claim 11 wherein the groove has a concave inner wall surface, and the diverter member further comprises a pivot member connected to the diverter panel, the pivot member pivotally securable in the groove with the diverter panel extending outwardly through the front slot and being articulable into physical contact with an upwardly facing surface of the flexible sheet-like article to direct rain and debris landing on the diverter panel away from any gaps formed between the structural member and an edge of the tarp.

13. The apparatus of claim 1 wherein the longitudinally extending track has a male T-shape in cross-section and the base of the fastener member is configured to be slidably secured to the male T-shaped track.

14. The apparatus of claim 13 wherein the male T-shaped track includes a stem portion connected to the web and an outer portion connected to the stem portion and extending laterally to the stem portion, defining an upper slot and a lower slot on opposite sides of the stem portion between the web and outer portion.

15. The apparatus of claim 13 wherein the fastener member includes an upper portion, a lower portion, a front portion joining and extending between the upper portion and lower portion, a first inwardly directed finger portion extending downwardly from the upper portion, and a second inwardly directed finger portion vertically aligned with the first finger portion and extending upwardly from the lower portion, a T-shaped slot defined by the upper portion, lower portion, front portion, and first and second finger portions configured to be slidably received on the T-shaped track from an end of the T-shaped track with the first finger portion inserted in upper slot, the second finger portion inserted in the lower slot, and the front portion extending over the outer portion of the T-shaped track.

16. The apparatus of claim 1 further comprising a threaded through-aperture formed in the fastener member, and a fastener having a threaded shaft configured to be received in the aperture and rotated until an outer end of the threaded shaft is forcibly pressing against the track to frictionally engage the fastener to the track.

17. The apparatus of claim 1 further comprising at least one aperture in the rear wall of the structural member for receiving a wall fastener.

18. A tarp support apparatus for supporting a tarp dimensioned to extend over a selected area and including a first end having an edge and an opposite second end having an opposite edge, comprising:

an elongated structural member including a web and track positioned on the web extending longitudinally; and at least one fastener member having a base configured to slidably engage with the longitudinally extending track, a receiving element connected to the base configured for connecting to a fitting secured along the first end of the tarp to secure the first end of the tarp to the fastener member with the opposite second end secured to another support, and a locking mechanism configured for locking the tarp fastener member against sliding on the track, wherein the longitudinally extending track and base of the at least one fastener member are in a male-female or female-male connection relationship.

19. The tarp support apparatus of claim 18 wherein the track further comprises a male extension structure.

20. The tarp support apparatus of claim 19 further comprising an elongated diverter member connectable to the structural member extending longitudinally above the longitudinally extending track, the diverter member including a diverter panel extending outwardly from the front side portion of the structural member over the male extension structure.

* * * * *